US005794383A

United States Patent [19]

Labinski

[11] Patent Number: 5,794,383

[45] Date of Patent: Aug. 18, 1998

[54] RECONFIGURABLE SEATING SYSTEM FOR MULTI-PURPOSE STADIUM

[75] Inventor: Ronald J. Labinski, Fairway, Kans.

[73] Assignee: Hellmuth, Obata & Kassabaum, Inc., Kansas City, Mo.

[21] Appl. No.: 712,810

[22] Filed: Sep. 12, 1996

[51] Int. Cl.[6] ..... E04H 3/12

[52] U.S. Cl. ..... 52/9; 52/8; 52/10

[58] Field of Search ..... 52/6, 8, 9, 10

[56] References Cited

U.S. PATENT DOCUMENTS

| | | | |
|---|---|---|---|
| 1,433,547 | 10/1922 | Hadden . | |
| 3,002,234 | 10/1961 | Waterbury . | |
| 3,241,270 | 3/1966 | Newman . | |
| 3,525,184 | 8/1970 | Harbers et al. | 52/9 |
| 3,975,869 | 8/1976 | Bouton . | |
| 4,162,594 | 7/1979 | Mackintosh . | |
| 4,688,357 | 8/1987 | Deaton . | |
| 5,103,600 | 4/1992 | Geiger et al. . | |

FOREIGN PATENT DOCUMENTS

| | | | |
|---|---|---|---|
| 406200644A | 7/1994 | Japan | 52/8 |

*Primary Examiner*—Robert Canfield

*Attorney, Agent, or Firm*—Litman, McMahon & Brown, L.L.C.

[57] ABSTRACT

A multi-purpose stadium includes a seating system which is reconfigurable between seating configurations corresponding to different playing fields, for example, football and baseball. Reconfiguration of the seating system is accomplished by removing removable seating sections, raising or lowering vertically movable seating sections, sliding or shifting horizontally movable seating sections and rotating groups of seating sections which form rotatable extensions of seating wings of a seating bowl formed by the seating system. The stadium includes a circulation system with concourses at various levels for providing access to the seating system. Bridges are provided for connecting parts of the concourses which are separated when the seating system is reconfigured.

28 Claims, 31 Drawing Sheets

RECONFIGURABLE SEATING SYSTEM FOR MULTI-PURPOSE STADIUM

BACKGROUND OF THE INVENTION

1. Field of the Invention

The present invention relates generally to multi-purpose stadiums, and in particular to a stadium with a seating system which can be reconfigured to accommodate different playing field configurations, such as football and baseball.

2. Description of the Related Art

Professional sporting events are one of the most popular forms of entertainment worldwide. The popularity of certain sporting events continues to grow, both in terms of the popularity of events at particular venues and the number of sports team franchises awarded.

Sports franchise owners and host cities are under considerable pressure to construct new facilities for sports use and to upgrade and enlarge existing facilities. With many cities and regions competing for a relatively small number of franchises in major professional sports such as football, baseball, etc., franchise owners are often able to obtain public financing for new stadiums or improvements to existing stadiums under threat of relocation.

Public financing for sports facility construction and improvement is often controversial because it tends to involve competing interests and objectives, particularly the objective of minimizing public debt financing with the objective of attracting and retaining professional sports teams. Since professional sports teams are important factors in local economies and additionally provide civic pride and recognition, most cities and regions with sizable populations are willing to support professional teams by financing the construction or improvements of appropriate sports facilities. However, there are limits to the public resources available for such projects and new tax increases, bond proposals and levies often encounter significant resistance from taxpayer groups and business owners who typically bear such financial burdens.

Facility location and site-related considerations are also important factors in sports facility design. For example, proximity to existing urban infrastructure, such as highways, downtown areas and other urban amenities can be desirable. Moreover, because stadiums tend to receive a great deal of media exposure, they are often located to take advantage of views of a city's skyline or other natural or manmade features. A well-designed sports facility which relates well to its site and the surrounding area can be an effective source of civic pride and can effectively promote the image of a city or a region.

In order to provide more efficient land use and accommodate different athletic and other events, multi-purpose stadiums and reconfigurable seating systems therefor have previously been devised. For example, the Hadden U.S. Pat. No. 1,433,547 discloses a grandstand which is pivotable between positions for football and baseball.

Another example, the Waterbury U.S. Pat. No. 3,002,234, discloses a stadium with a circular plan configuration with seating sections which are relocatable between baseball and football positions.

The Newman U.S. Pat. No. 3,241,270 discloses a convertible stadium with an elliptical plan configuration and seating sections which are relocatable between baseball and football positions.

The Bouton U.S. Pat. No. 3,975,869 discloses a sports complex with movable stands for defining seating arrangements for different sports activities, including baseball, football, hockey and basketball.

The MacIntosh U.S. Pat. No. 4,162,594 discloses movable grandstand seating sections and a seating reconfiguration method.

The Deaton U.S. Pat. No. 4,688,357 discloses a multiple-purpose stadium system provided for reconfiguring the seating between, for example, football and baseball configurations. A playing surface adapted for repositioning is also shown therein.

In spite of a number of attempts to accommodate different major sporting events in a single facility, the results have generally compromised the effectiveness of the facility for one or both of such activities. The problems associated with reconfiguring seating for different sports activities include different preferred seating arrangements, different sightlines, different playing field shapes and different preferred circulation system configurations for accessing the seating.

Another issue faced by multi-purpose stadium designers relates to different optimal capacities for sporting events such as baseball and football. For example, the optimal capacity for major league baseball stadiums is generally about 40,000 to 50,000. Major league football games, on the other hand, are much fewer in number and consequently tend to draw larger crowds. The optimal seating capacity for football is generally considered to be approximately 65,000 to 70,000. Thus, a reconfigurable seating system intended to accommodate sports such as football and baseball should not only change configuration but should also change seating capacity.

In view of the strong demand for state-of-the-art facilities which provide optimal playing conditions and maximum spectator amenities, there is little room for compromise in the current market for sports facilities. Thus, a city or region commissioning a multi-purpose stadium must exercise caution not to compromise the effectiveness of the facility for either sport, or risk losing one or both of the major league sports franchises to other venues offering more attractive separate facilities. Thus, in order to be competitive a multi-purpose stadium must be substantially equal to dedicated-sports facilities in providing optimal playing conditions and maximum spectator amenities.

The present invention addresses such deficiencies in prior art multi-purpose stadium facilities. Heretofore there has not been available a multi-purpose stadium with the advantages and features of the present invention.

SUMMARY OF THE INVENTION

In the practice of the present invention, a multi-purpose stadium is provided which includes a reconfigurable seating system for accommodating different playing fields, for example, football and baseball. The seating system includes a horizontally movable band of seating sections adapted for sliding or rolling movement on a playing area surface and a vertically movable band of seating sections which can be raised to a use position for football seating and lowered to a storage position when not needed, for example, in a baseball configuration. An outer band of seating sections is located radially outwardly from the vertically movable band of seating sections and partially surrounds the playing area. A removable band of seating sections is provided for use in a football configuration in one of the end zones and along one of the sidelines. A plurality of infill seating sections are provided for installation between the horizontally movable band seating sections, which separate to form gaps when the horizontally movable seating section band expands radially to a baseball configuration. The seating sections form a seating bowl with a base and a pair of wings. Each seating bowl wing has a rotatable extension which is rotatable about a respective vertical pivotal axis. In a football configuration the extensions are generally aligned with the wings parallel to the football playing field sidelines. In a baseball configuration the wing extensions rotate inwardly to partially enclose a baseball playing field. The stadium also includes a circulation system with concourses on multiple levels and vertical circulation comprising ramps, stairs and elevators. The stadium further includes a support system for accommodating spectators, staff and teams and for supporting activities in the stadium.

OBJECTS AND ADVANTAGES OF THE INVENTION

The principle objects and advantages of the present invention include: providing a multi-purpose stadium; providing such a stadium with a reconfigurable seating system; providing such a stadium with a seating system having football and baseball configurations; providing such a stadium which optimizes spectator views and field proximity for different playing field configurations; providing such a stadium which includes a horizontally movable band of seating sections adapted for contracting radially inwardly and expanding radially outwardly; providing such a stadium which includes a vertically movable band of seating sections adapted for raising and lowering between use and storage positions; providing such a stadium which includes removable or relocatable seating sections; providing such a stadium which includes a seating bowl having a base and wings, each wing having a rotatable extension comprising a group of seating sections; providing such a stadium which can be reconfigured for different activities with different seating capacities appropriate to such activities; providing such a stadium which can be adapted to various sites; providing such a reconfigurable seating system which can be retrofit to existing stadiums; providing such a stadium which can be embodied in various structural forms, including open-air and covered structures; providing such a stadium which can facilitate efficient land usage by accommodating multiple activities in different configurations; providing such a stadium which can significantly reduce the overall costs of sports facilities for different activities as compared to the cost of constructing, maintaining and operating separate sport-specific facilities; and providing such a stadium which is efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1A:
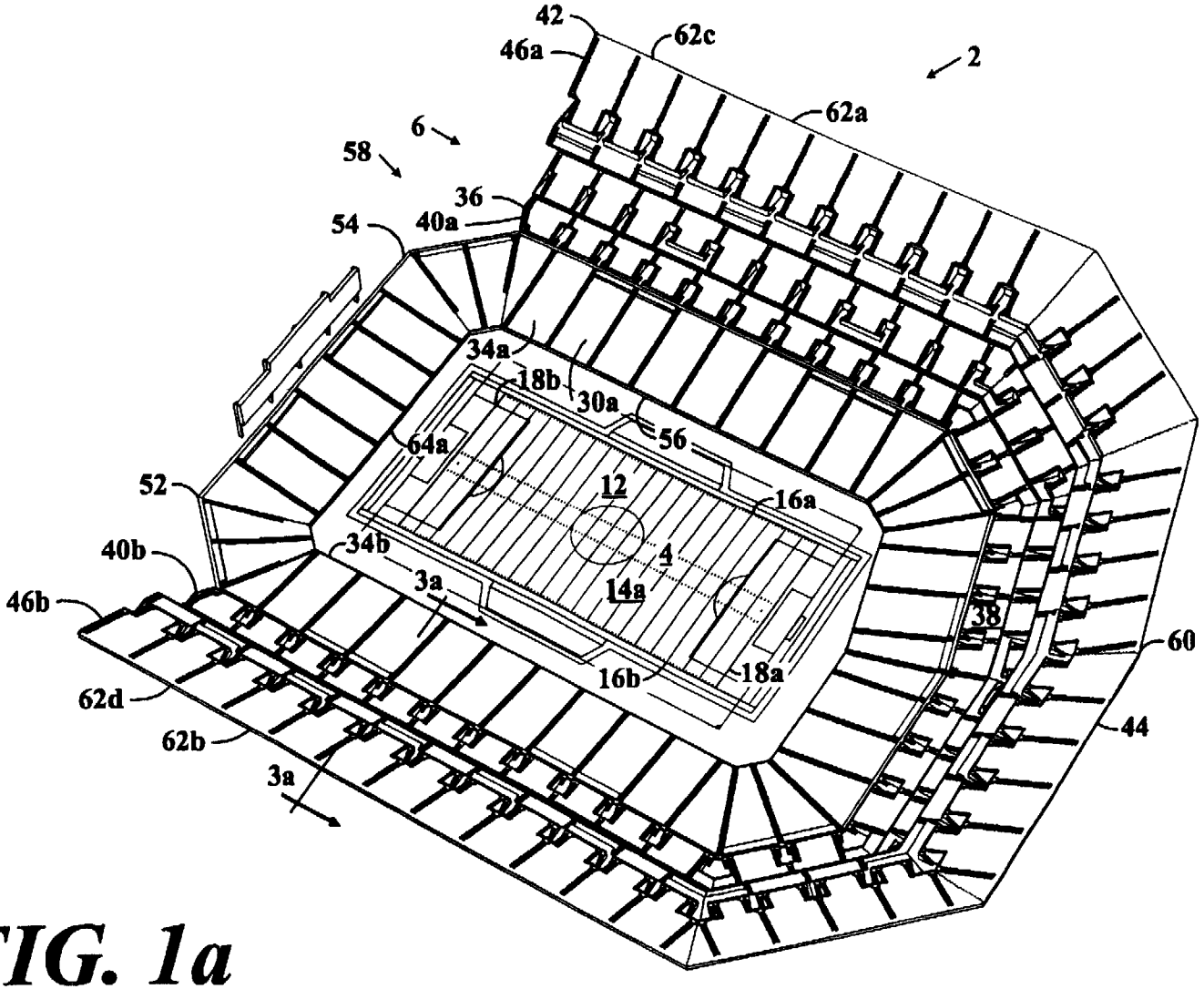
FIG. 1*a* is an upper, perspective view of a multi-purpose stadium with a reconfigurable seating system embodying the present invention, shown in a football configuration.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a multi-purpose stadium embodying the present invention. The stadium 2 generally includes a playing area 4, a seating system 6, a circulation system 8 and a support system 10.

II. Playing Area 4

The playing area 4 includes a generally level surface 12. In the illustrated embodiment alternative playing fields 14*a*, 14*b* are provided for football and baseball respectively, although the playing area 4 could be adapted to provide other playing fields for various other sports, such as, without limitation, soccer, ice hockey, basketball, tennis, etc.

The football playing field 14*a* includes first and second sidelines 16*a*, 16*b*; and opposite first and second ends 18*a,b* with first and second goal posts 20*a,b* respectively.

The baseball playing field 14*b* includes first, second, third, fourth and fifth sides 22*a,b,c,d,e* respectively, with the first and fifth sides 22*a,e* forming an intersection 24 in proximity to a home plate 26 of a conventional baseball diamond 28. The baseball playing field 14*b* includes an axis 29 extending from the home plate intersection 24 to the third side 22*c* (i.e., center field wall) which, by regulation, is approximately 400 feet, corresponding to the distance the ball must travel in the air for a home run.

III. Seating System 6

The seating system 6 includes a first configuration (FIG. 9) corresponding to the configuration of the football field 14*a* and a second configuration (FIG. 18) corresponding to the configuration of the baseball field 14*b*.

A horizontally-movable band 30 of seating sections 30*a, b,c,d,e,f,g,h* is provided in proximity to the football playing field 14*a*. The sections 30*c–f* form a horizontally-movable band base 32 and the seating sections 30*a,b* and 30*g,h* form first and second horizontally-movable band wings 34*a*, 34*b*.

The horizontally movable band sections 30*a–h* are horizontally movable on suitable wheels 31 which can be adapted for traversing the playing area surface 12 without damaging same. Alternatively, other suitable means for facilitating horizontal translation can be utilized, such as rails, tracks, etc.

Figure 3A:
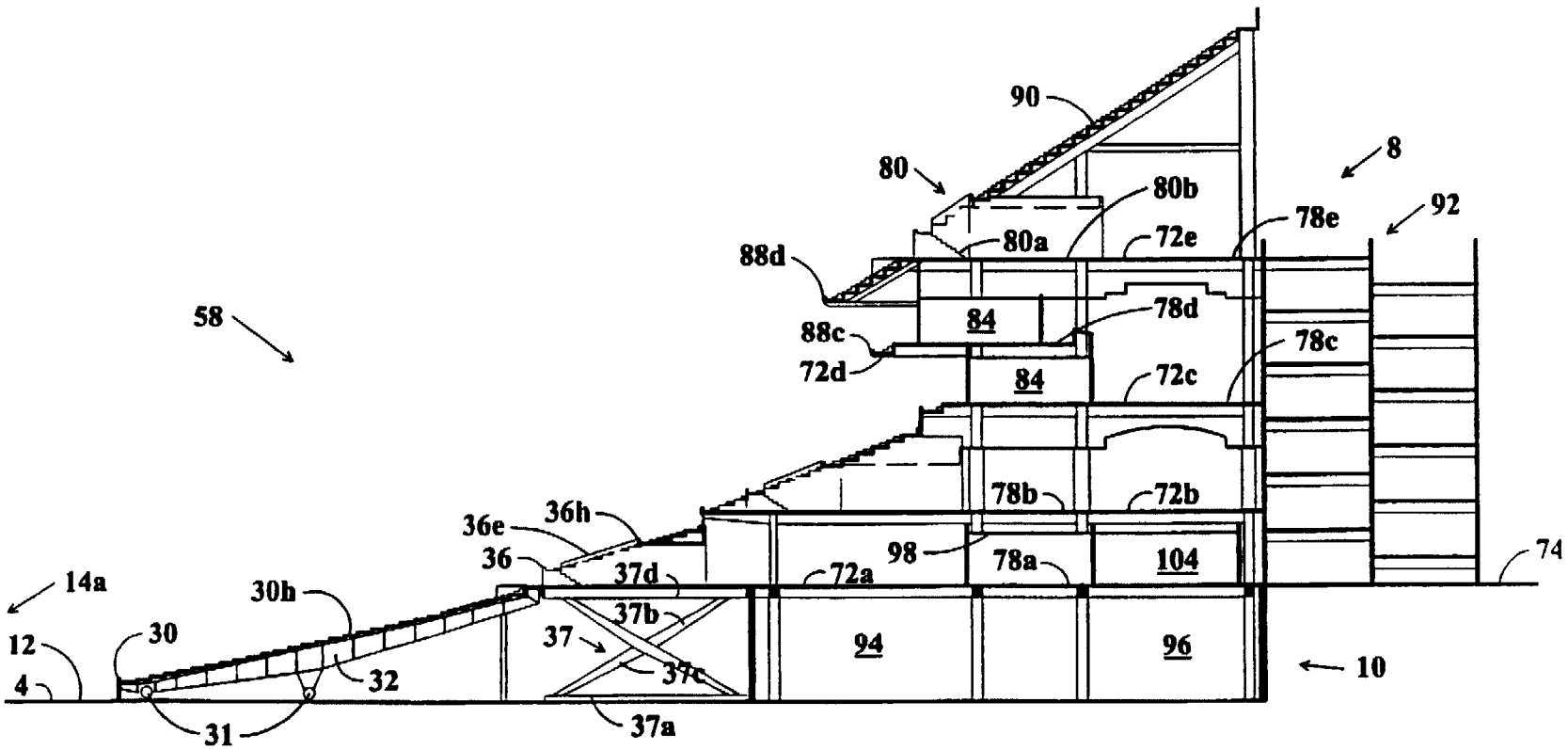
FIG. 3*a* is a vertical cross-section of the stadium in a football configuration, taken generally along line 3*a*—3*a* in FIG. 1*a*.
Figure 3B:
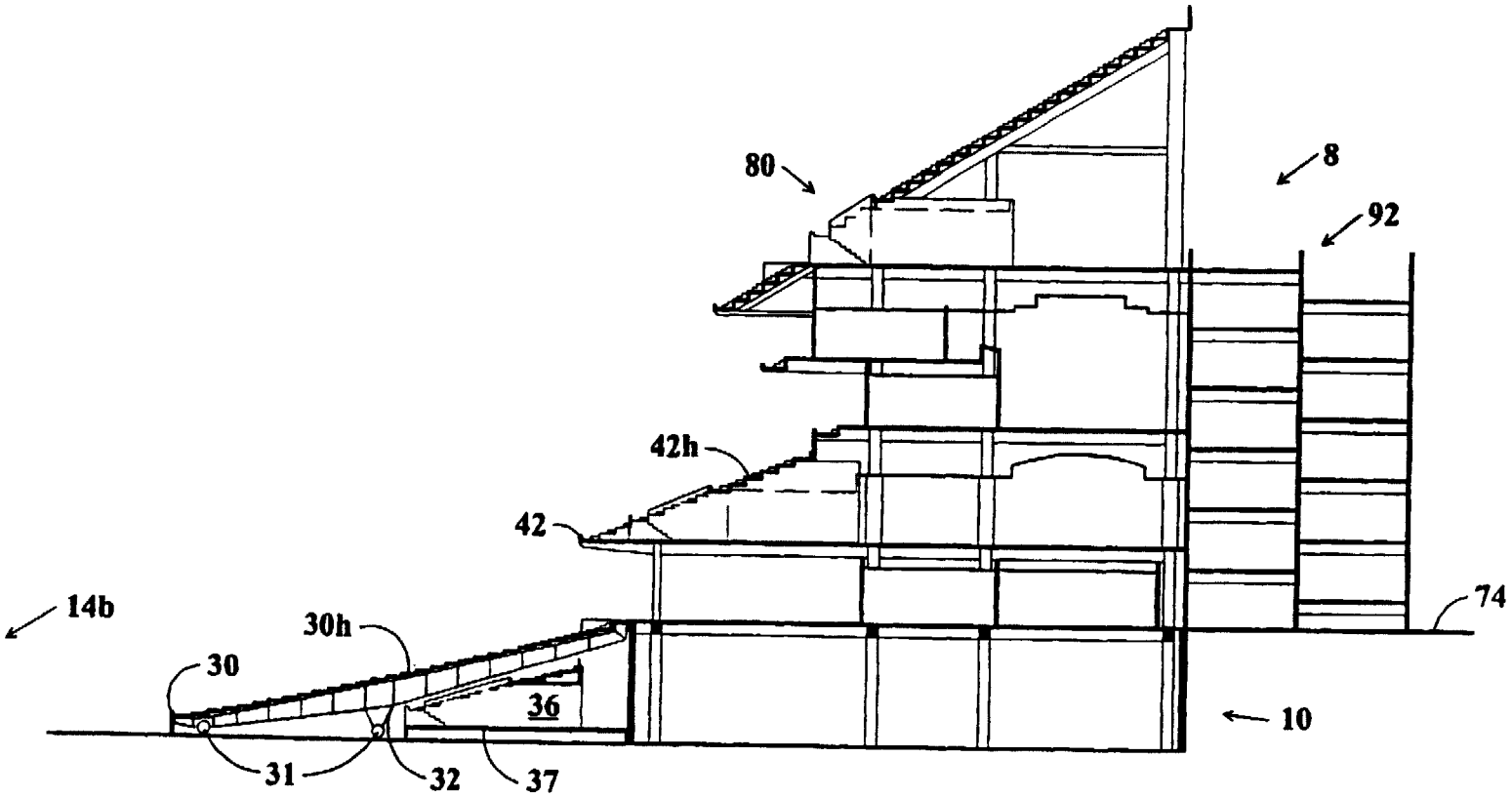
FIG. 3*b* is a vertical cross-section of the stadium in a baseball configuration, taken generally along line 3*b*—3*b* in FIG. 1*b*.
Figure 4A:
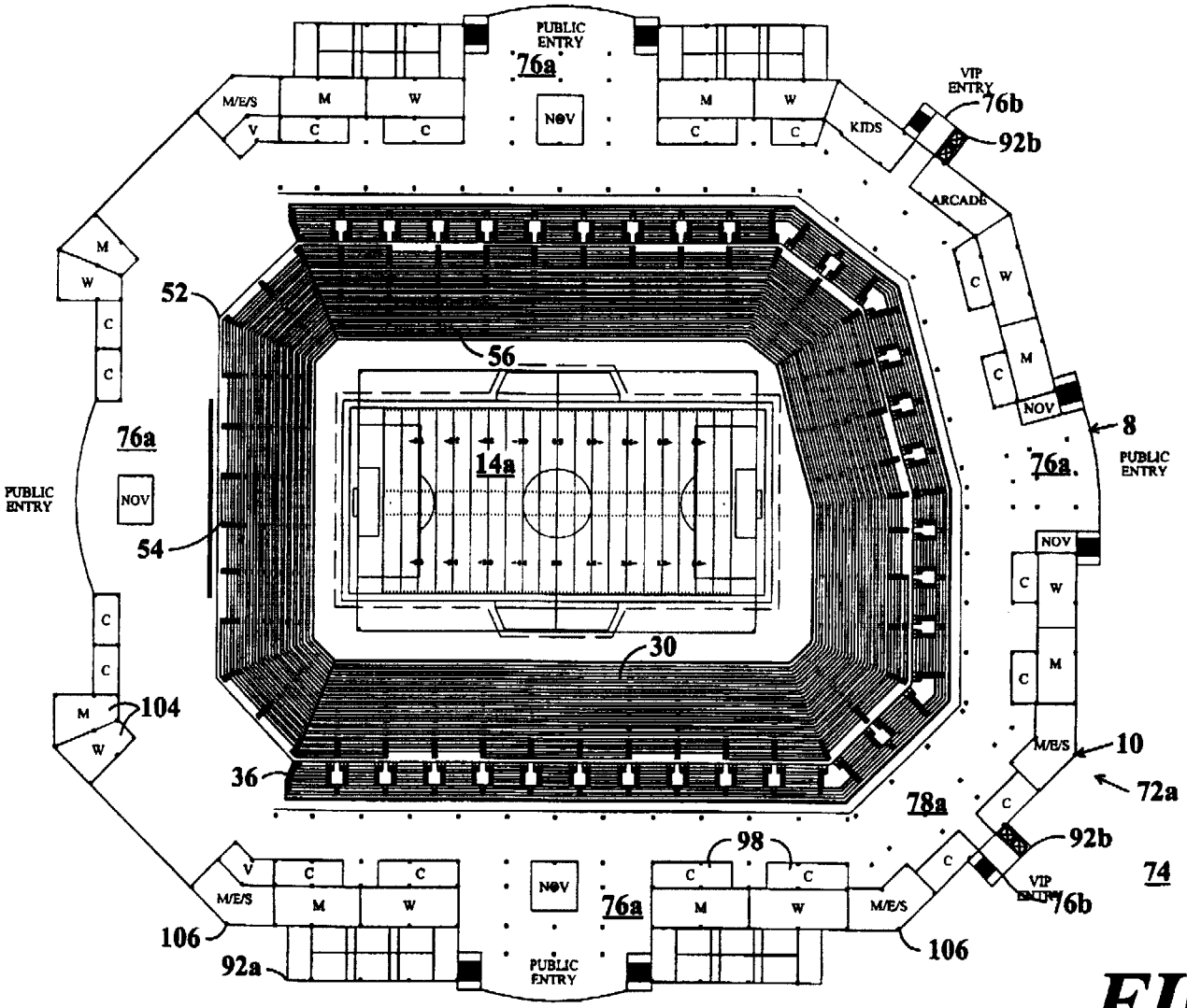
FIG. 4*a* is a plan view of a main concourse level of the stadium in a football configuration.
Figure 4B:
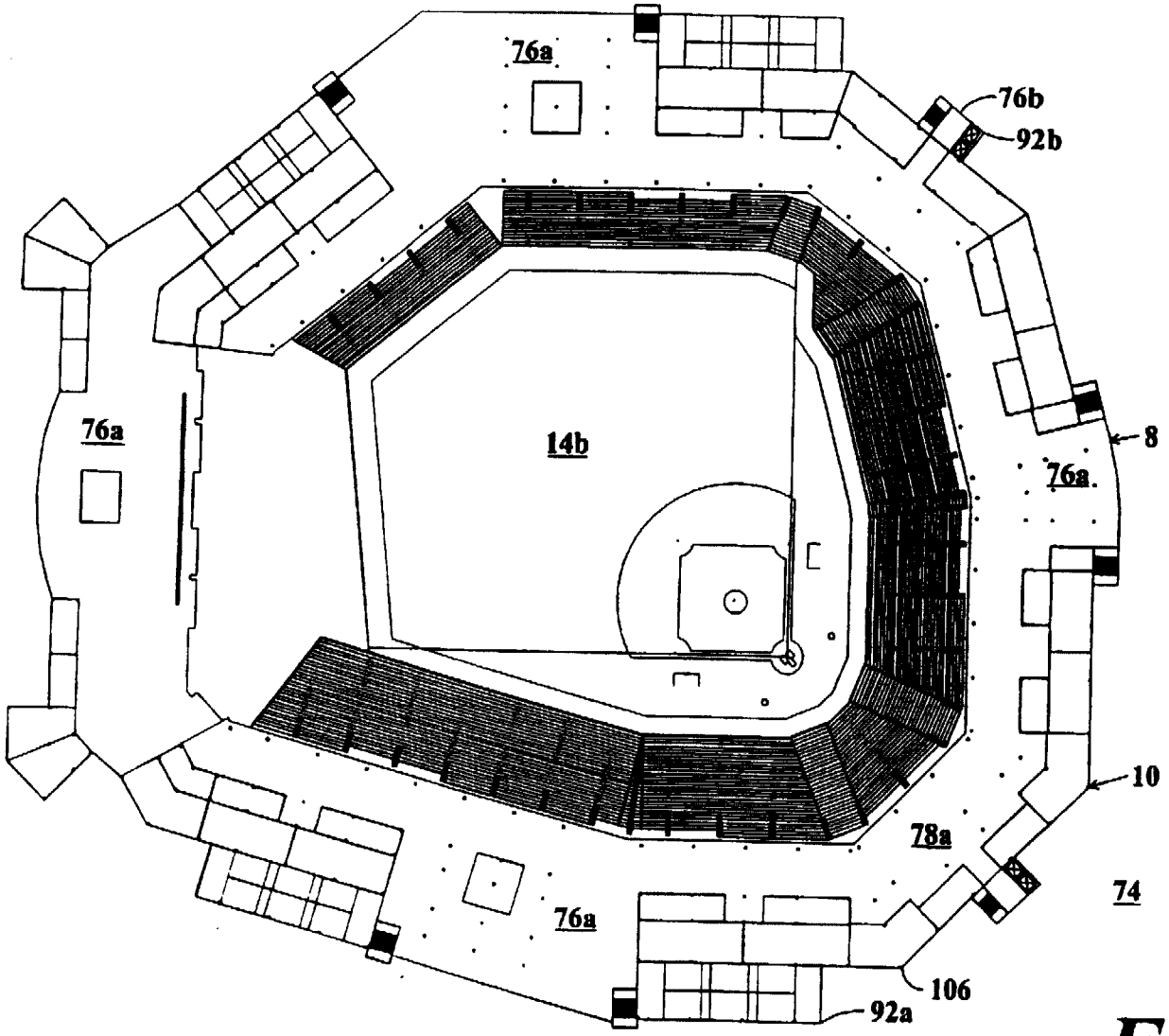
FIG. 4*b* is a plan view of the main concourse level of the stadium in a baseball configuration.
Figure 5A:
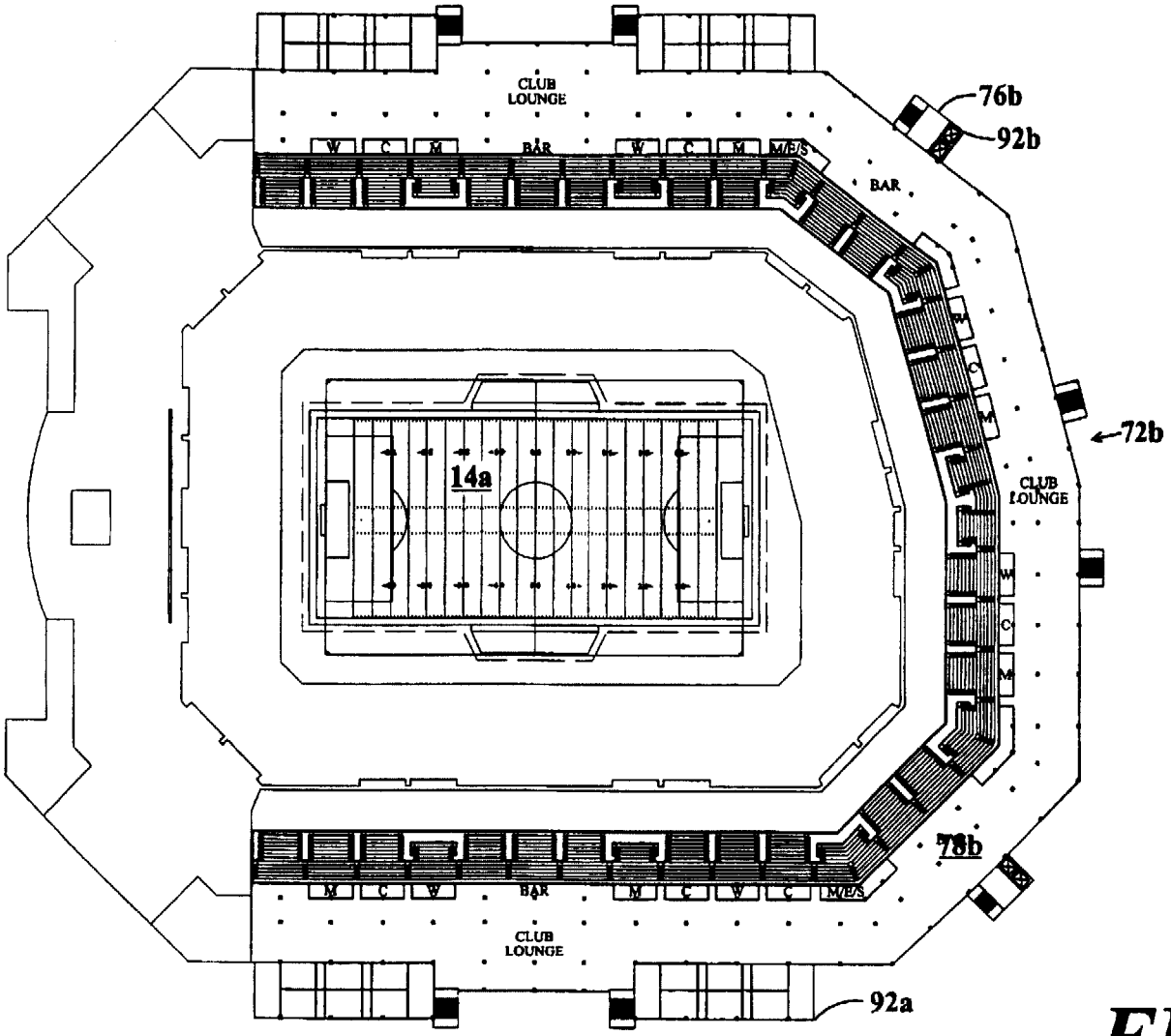
FIG. 5*a* is a plan view of a club level of the stadium in a football configuration.
Figure 5B:
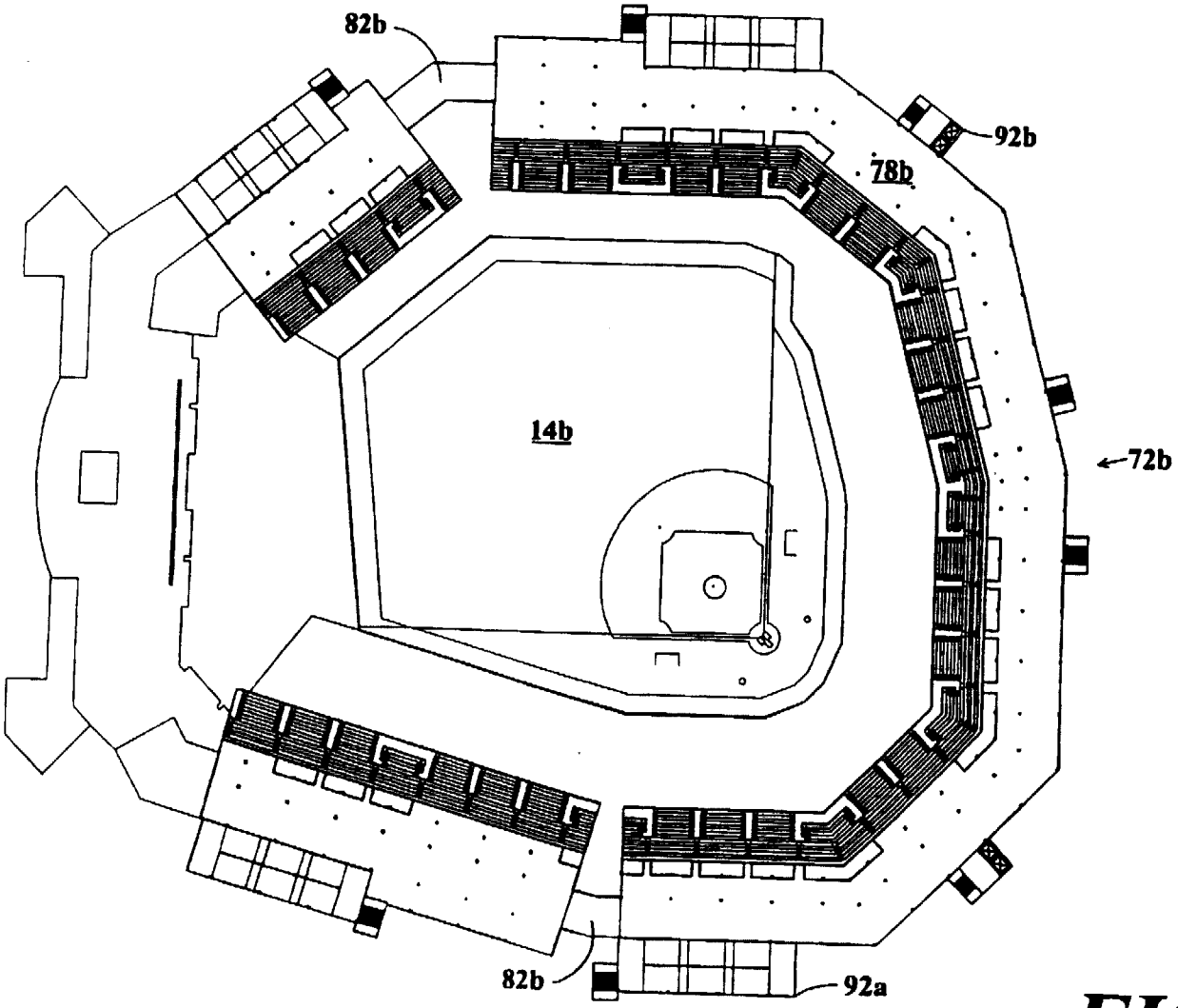
FIG. 5*b* is a plan view of the club level of the stadium in a baseball configuration.
Figure 6A:
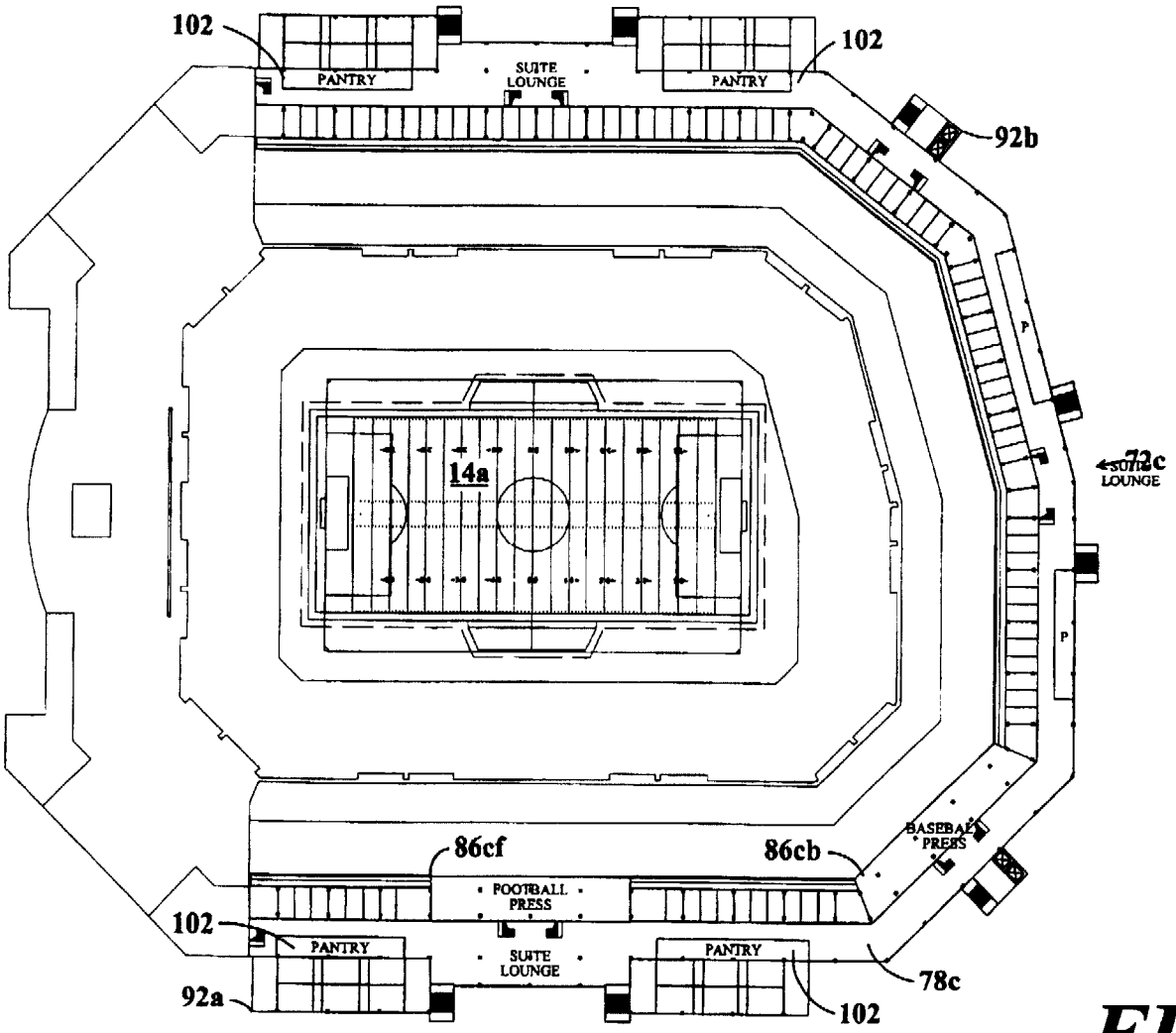
FIG. 6*a* is a plan view of a lower suite level of the stadium in a football configuration.
Figure 6B:
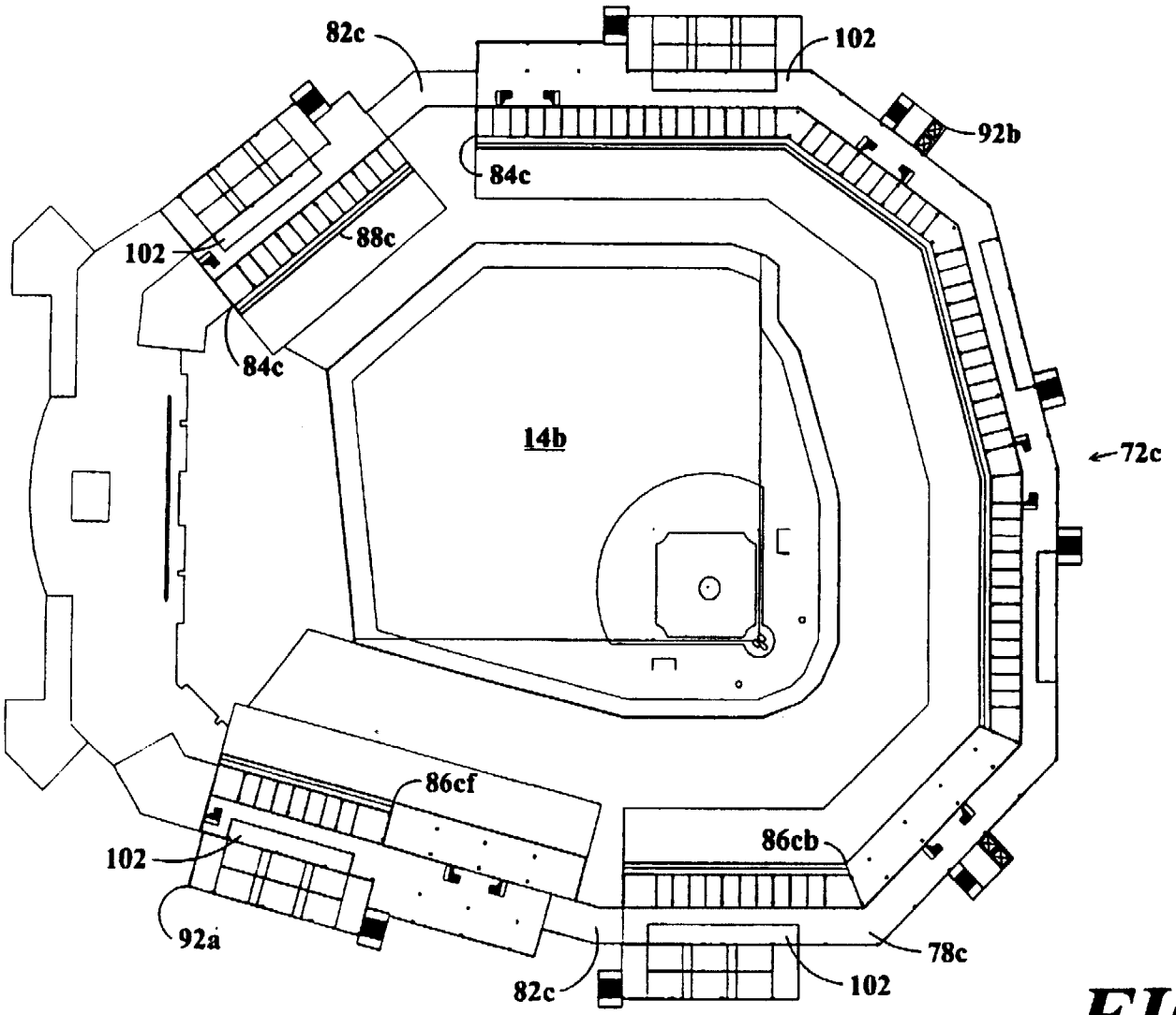
FIG. 6*b* is a plan view of the lower suite level of the stadium in a baseball configuration.
Figure 7A:
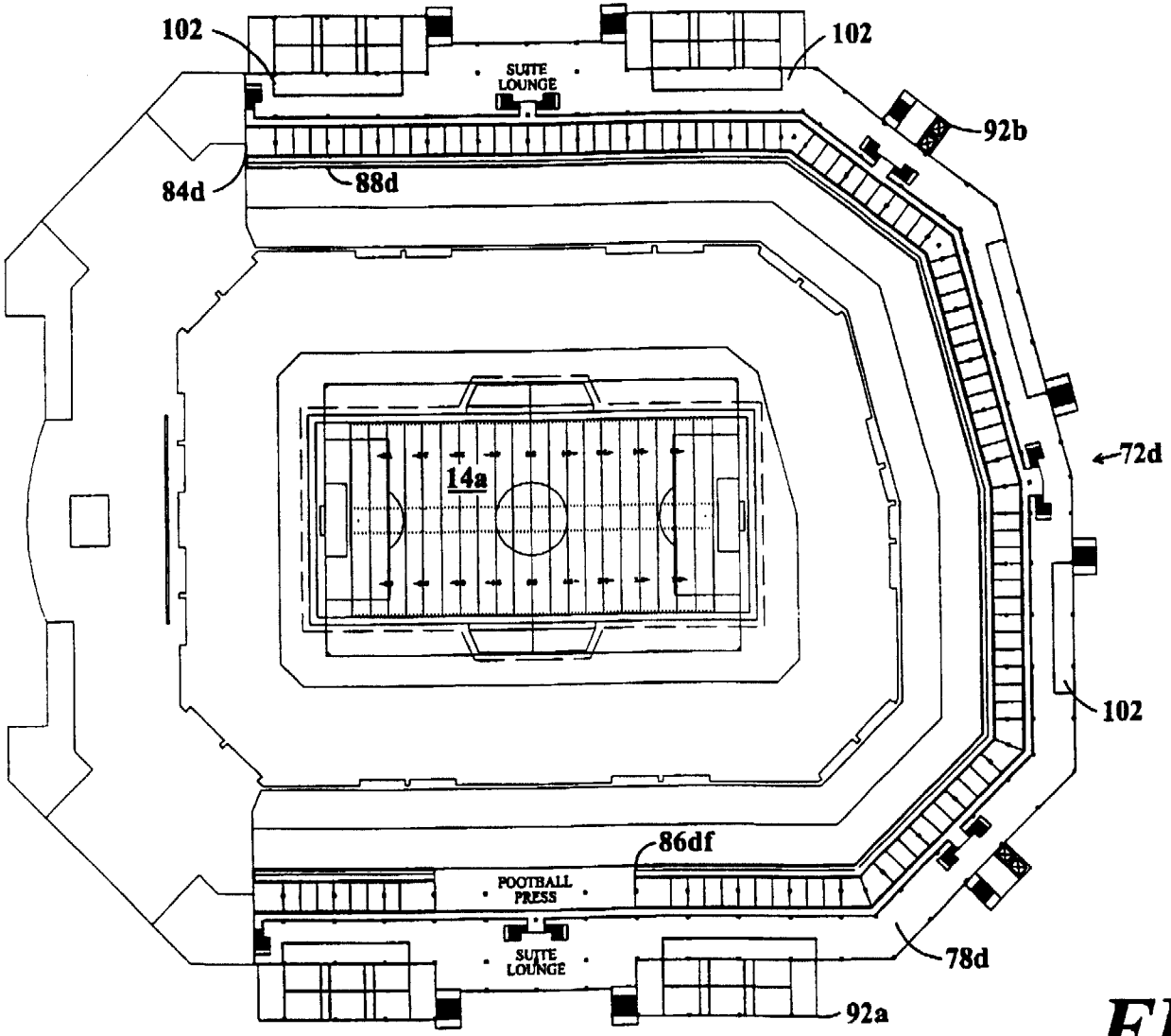
FIG. 7*a* is a plan view of an upper suite level of the stadium in a football configuration.
Figure 7B:
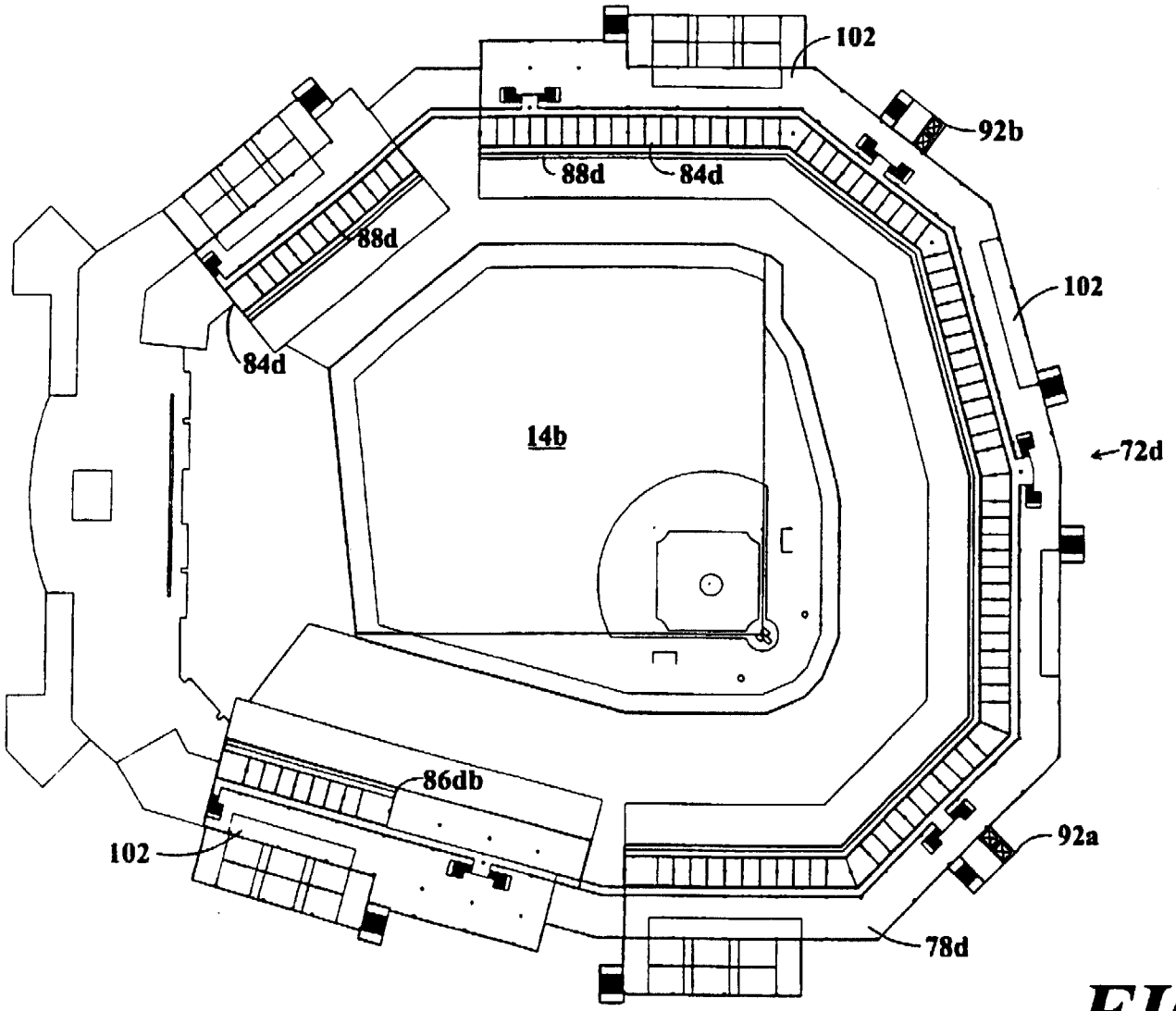
FIG. 7*b* is a plan view of the upper suite level of the stadium in a baseball configuration.
Figure 8A:
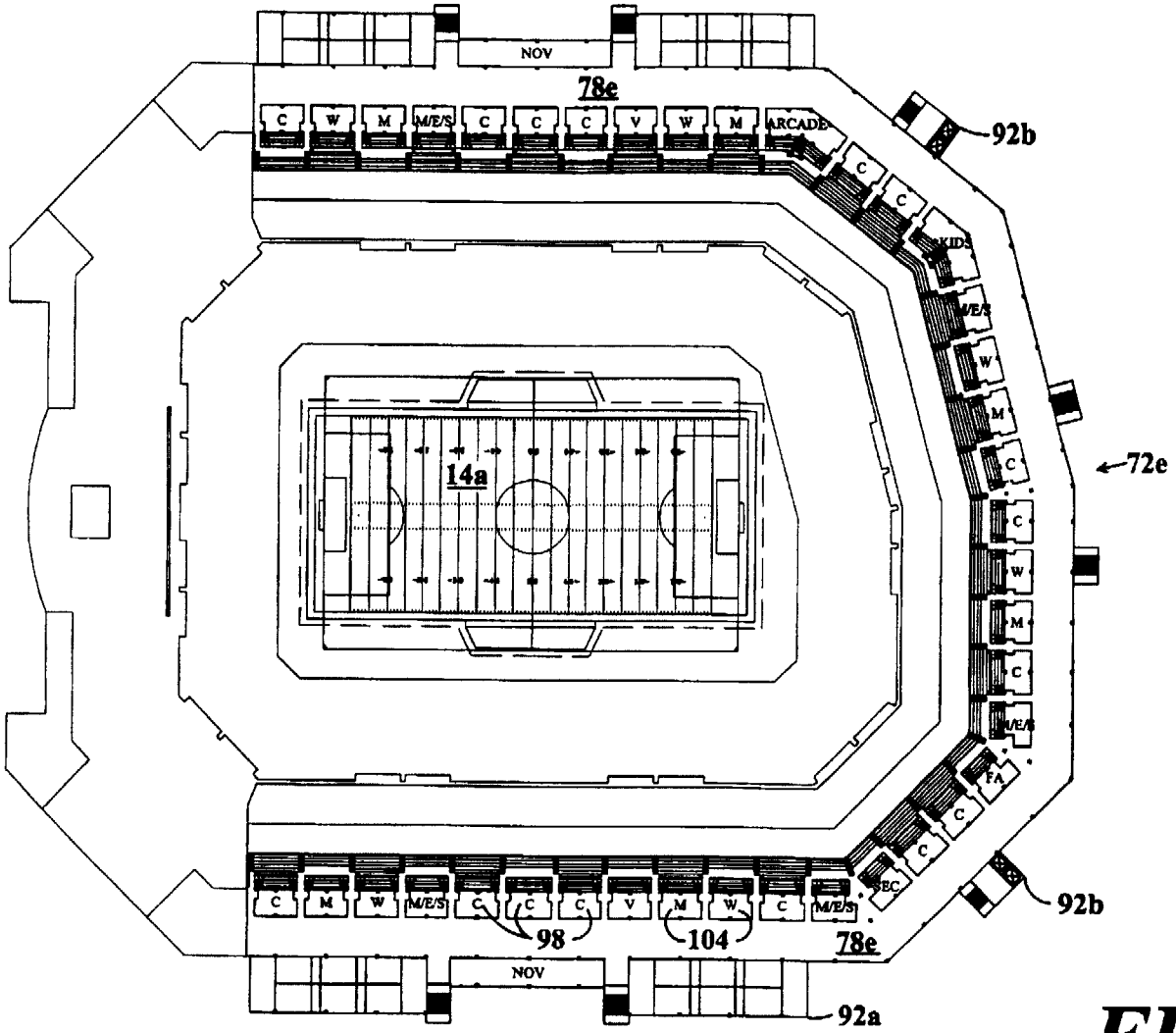
FIG. 8*a* is a plan view of an upper concourse level of the stadium in a football configuration.
Figure 8B:
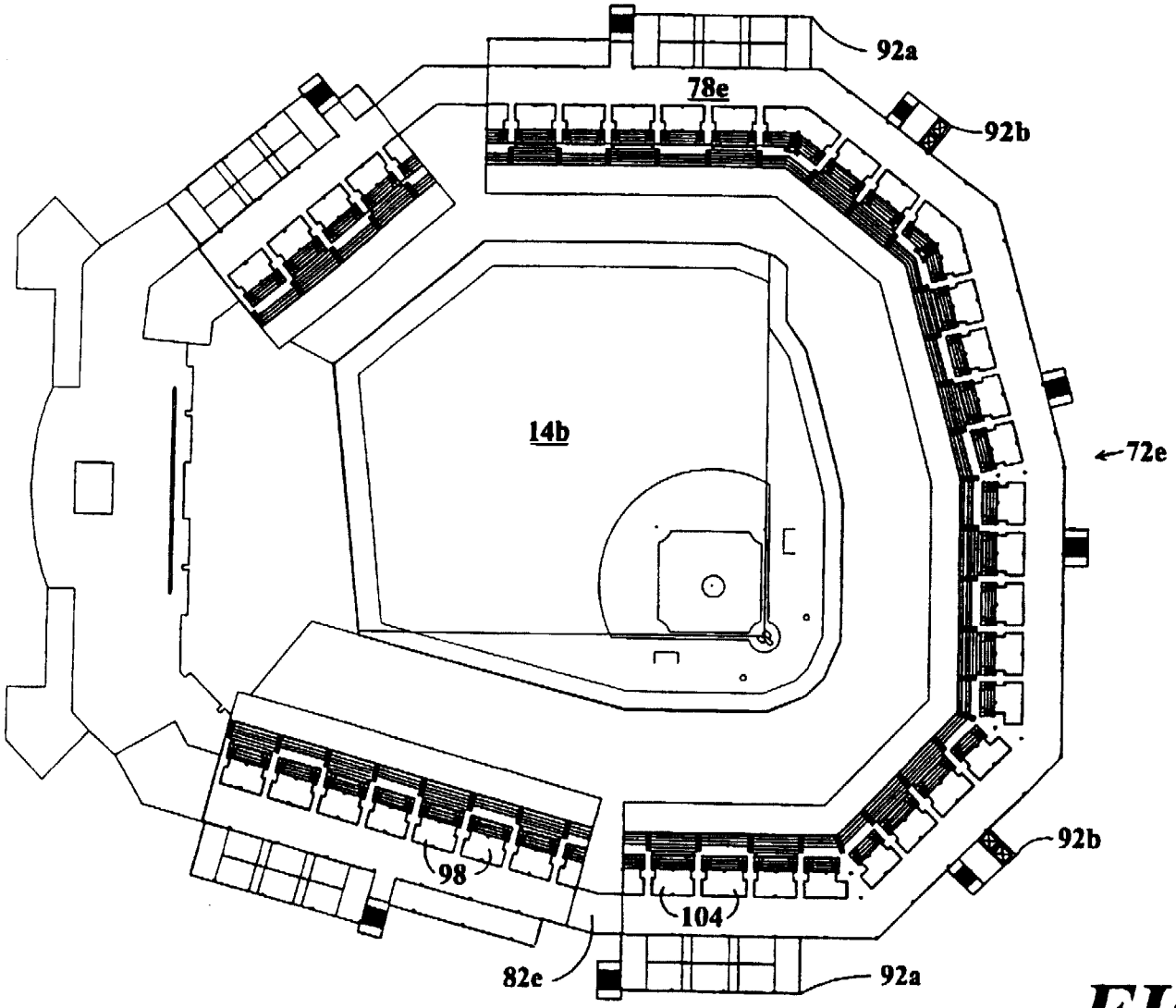
FIG. 8*b* is a plan view of the upper concourse level of the stadium in a baseball configuration.

A vertically movable band of seating sections 36*a–h* is located radially outside the horizontally movable band 30 and is adapted for raising and lowering between a raised, use position for football (FIG. 3*a*) and a lowered, storage position for baseball (FIG. 3*b*). Each vertically movable band section 36*a–h* is provided with a scissor-type lift 37 including a base frame 37*a*, a pair of pivotally interconnected base arms 37*b,c* connected to the base frame 37*a* and an upper frame 37*d* mounting a seating deck 37*e* (FIGS. 3*a* and 3*b*). Other lift or jack means for vertically moving the seating sections 36*a–h* could also be employed, such as hydraulic rams, mechanical systems, etc.

An outer band of seating sections 42*a–k* is provided on the outside of the vertically movable band in a football configuration with sections 36*a–h* adjacent sections 42*a–h*. In a baseball configuration outer band sections 42*a–h* are adjacent horizontally movable band sections 30*a–h*. The outer band includes a base 44 comprising seating sections 42*c–f*, a first wing 46*a* comprising seating sections 42*a,b* and a second wing 46*b* comprising seating sections 42*g,h*.

A removable band 52 of seating sections 52*a–f* includes a base 54 with seating sections 54*a–c* and a wing 56 with seating sections 52*d–f*.

The seating system 6 forms a seating bowl 58 comprising the seating section bands 30, 36, 42 and 52 which generally surrounds the football playing field 14*a* and at least partly surrounds the baseball playing field 14*b*. The seating bowl 58 includes a base 60 formed by the band bases 32, 38, 44 and 54; a first wing 62*a* formed by the band first wings 34*a*, 40*a*, 46*a* and 56 and a second wing 62*b* formed by the band second wings 34*b*, 40*b* and 46*b*.

The seating bowl wings 62*a,b* include rotatable extensions 62*c,d* which are rotatable about vertical rotational axes 62*e,f* located generally along a field wall 64 of the seating bowl 58. The field wall 64 has a football configuration 64*a* and a baseball configuration 64*b*. The first rotatable wing extension 62*e* comprises the seating sections 30*a*, 36*a* and 42*a*. The second rotatable wing extension 62*b* comprises the seating sections 30*h*, 36*h* and 42*h*. The rotatable extensions 64*c,d* can be rotated between their football positions aligned with respective wings 62*a,b* and their baseball positions angled inwardly therefrom by any suitable means. For example, towing and pushing equipment such as tractors, bulldozers and the like could be utilized, as well as jack mechanisms, hydraulic rams and the like.

Figure 1B:
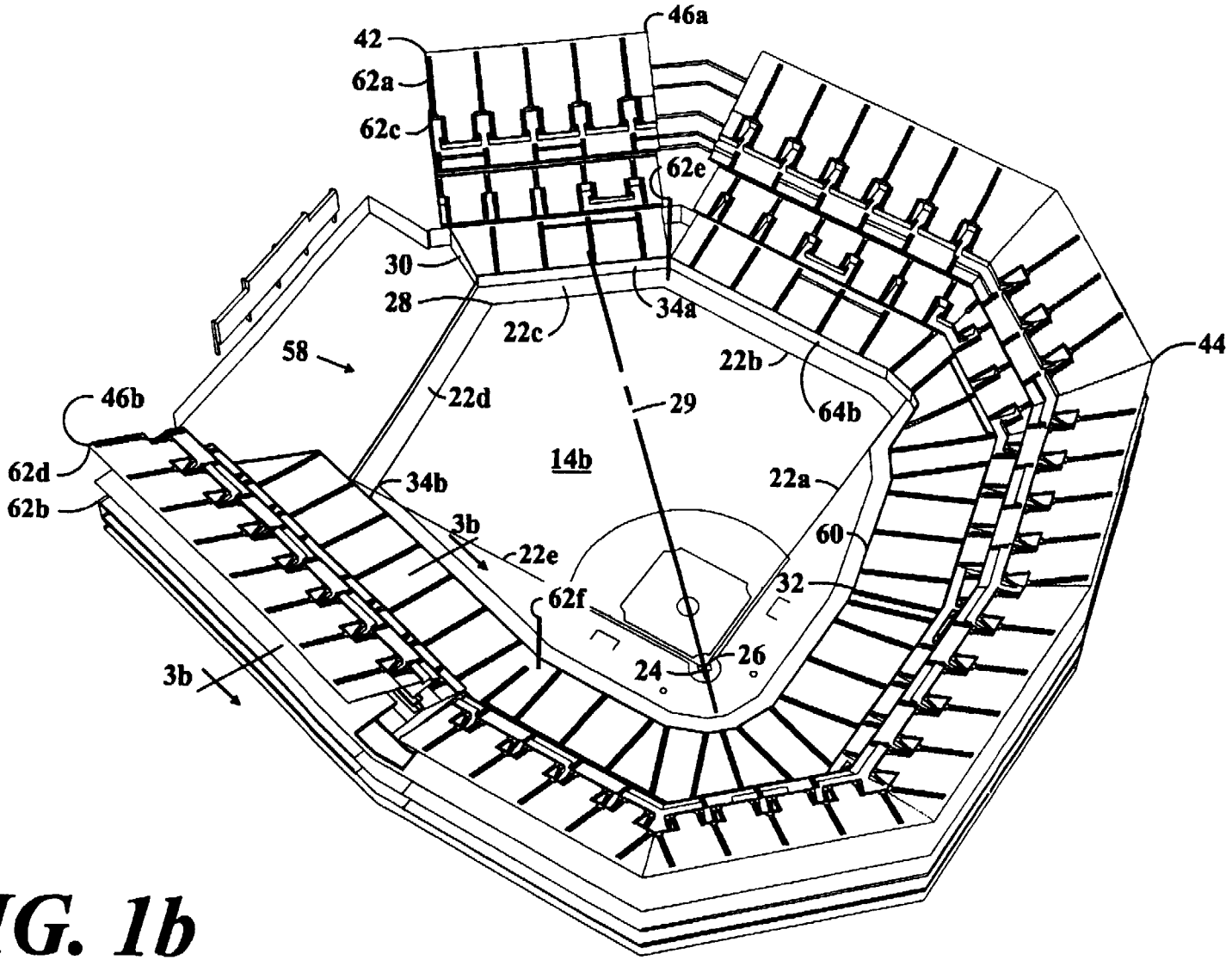
FIG. 1*b* is an upper, perspective view of the stadium, shown in a baseball configuration.
Figure 2A:
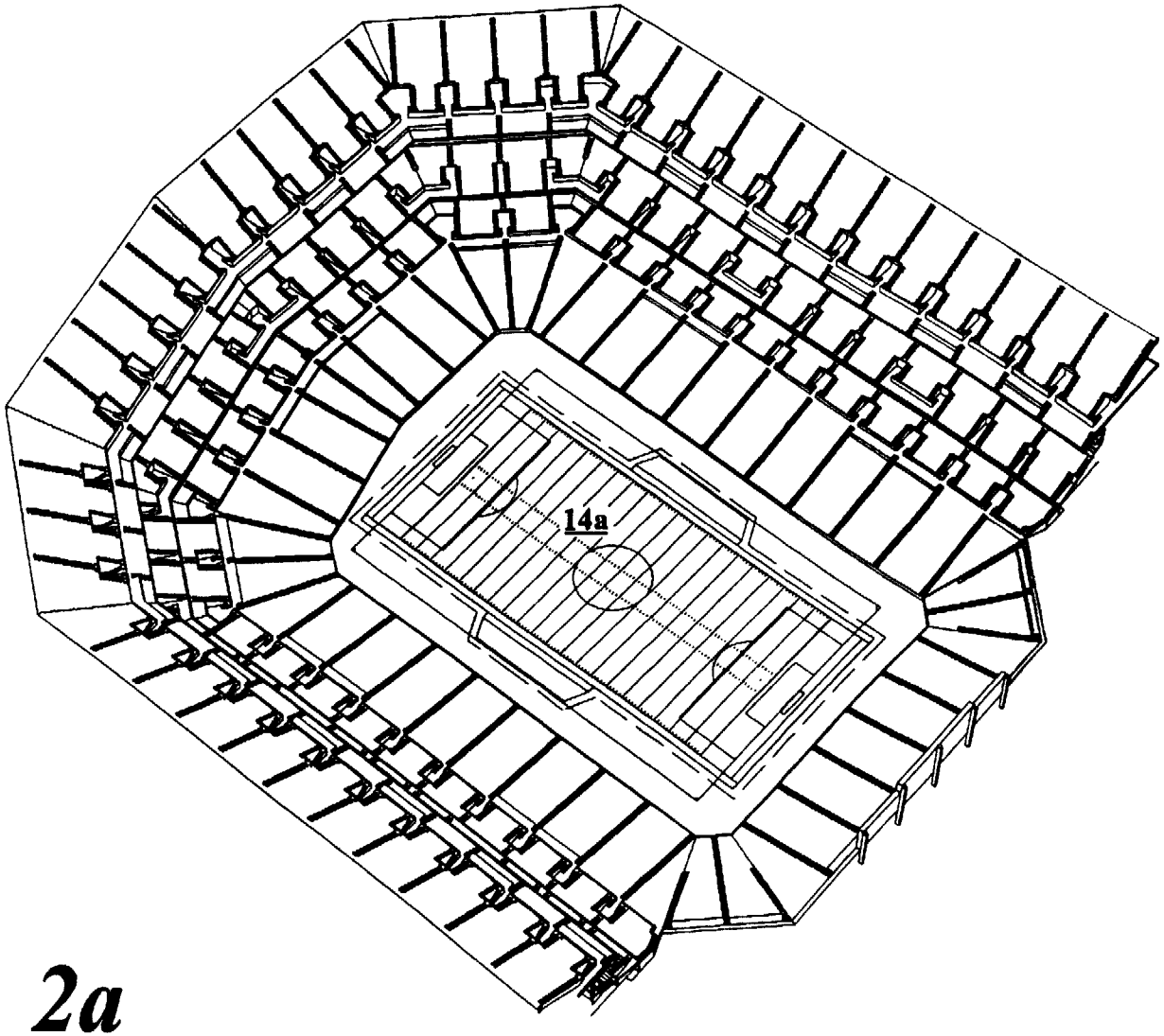
FIG. 2*a* is an upper, perspective view of the stadium, shown in a football configuration.
Figure 2B:
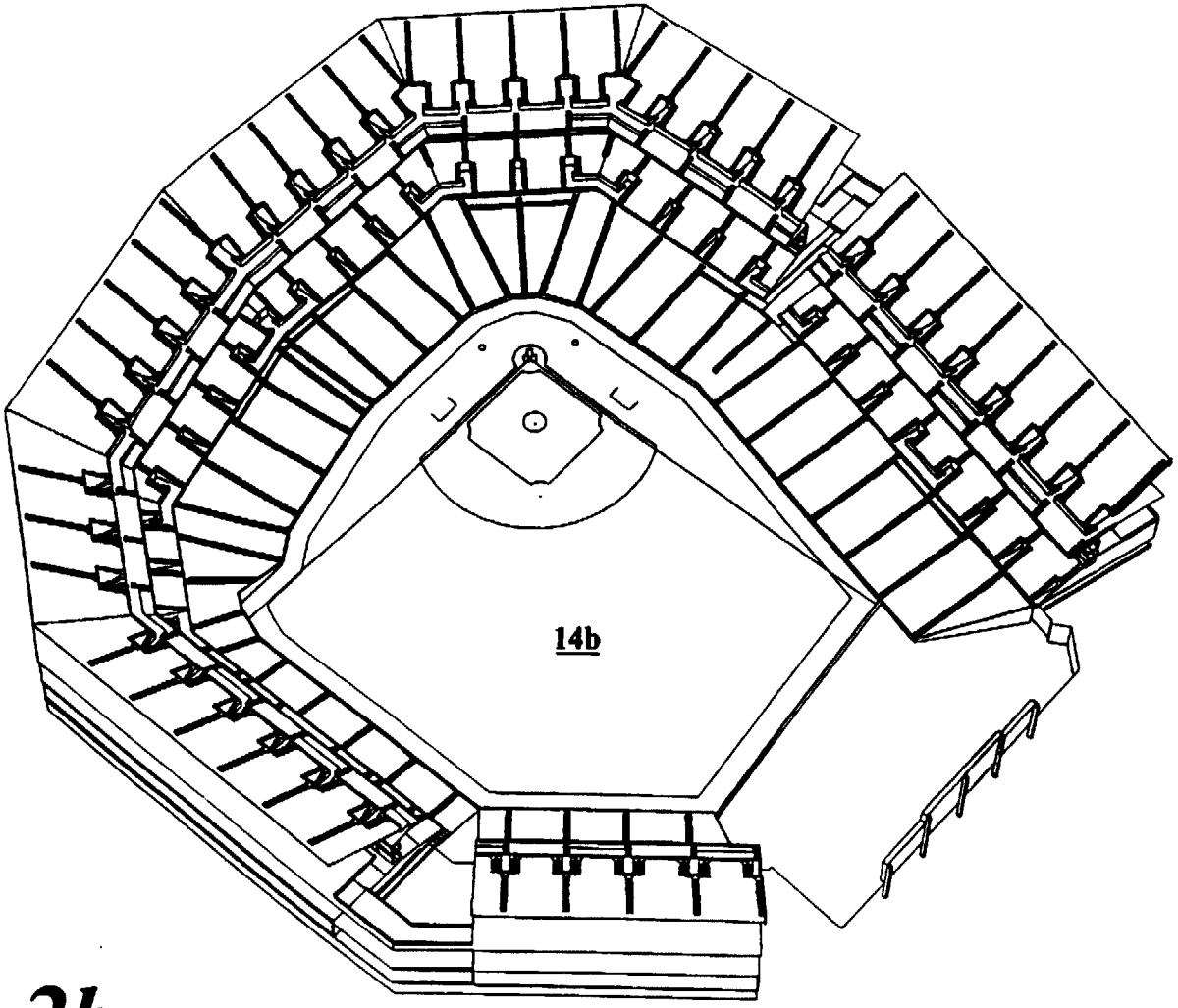
FIG. 2*b* is an upper, perspective view of the stadium, shown in a baseball configuration.

The seating system 6 further includes infill seating 68 comprising a plurality of individual seating sections 68*a,f* for removable positioning between respective horizontally movable sections 30*b–h*. The infill seating sections 68*a–f* are used in the baseball configuration (FIGS. 1*b*, 2*b* and 18) and are removably inserted in respective gaps or pockets 70*a–f* which are formed between respective horizontally-movable sections 30*b–h* due to the expansion radially outwardly of the horizontally movable band 30 in a conversion from football to baseball. In a football configuration, the infill seating sections 68*a–h* are not required and can be stored at some suitable location.

IV. Circulation System 8

The circulation system 8 accommodates both horizontal and vertical circulation among multiple levels of the seating system 6 and the support system 10, and further provides ingress and egress to the multi-purpose stadium 2. The stadium 2 can comprise different numbers of levels within the scope of the invention. The multi-level configuration described herein thus comprises an example only, which could be adapted to meet the requirements of particular facilities.

The levels 72 include: a main concourse level 72*a*, which is generally located approximately at ground level; and proceeding upwardly, a club level 72*b*; a lower suite level 72*c*; an upper suite level 72*d*; and an upper concourse level 72*e*.

The main concourse level 72*a* is generally located on a level with the surrounding site ground level 74, from which parking and transportation (not shown) can be available. Public and private (V.I.P.) entries 76*a,b* are located on the main concourse level 72*a* and provide access to a main concourse 78*a*. The main concourse 78*a* can completely encircle the football playing field 14*a* and the horizontally movable and removable seating section bands 30, 52. In a baseball configuration the main concourse 78*a* extends partly around the baseball playing field 14*b*.

In a football configuration the main concourse 78*a* provides access to the horizontally movable seating band 30, the removable seating band 52 and, through suitable vomitoria 80, the vertically movable seating band 36. The vomitoria 80 comprise stairs 80*a* and passages 80*b* and are configured as required to provide access from the circulation system 8 to the seating system 6, generally through a combination of stairs and passages.

In a baseball configuration the main concourse 78 provides access to the horizontally movable seating band 30 and the infill seating 68.

At the next level up, the club level 72*b*, a club level concourse 78*b* is provided generally above the main concourse 78*a* and provides access to a club level portion of the outer seating section band 42 through vomitoria 80. In a baseball configuration the club level concourse 78*b* is broken by gaps or pockets 70*a*, 70*f* formed by the inward rotation of the seating bowl wing extensions 62*c,d*. Club level bridges 82*b* are provided in the club level concourse 78*b* for bridging the pockets 70*a,f*.

The lower suite level 72*c* includes a suite level concourse 78*c* and bridges 82*c*. Access is provided to lower suites 84*c* and football and baseball press boxes 86*cf,cb* respectively. Balconies 88*c* are provided inside the lower suites 84*c*.

The upper level 72*d* includes an upper suite level concourse 78*d* providing access to upper suites 84*d* and upper football and baseball press boxes 86*df,db*. Upper balconies 88*d* are located inside the upper suites 84*d*.

The upper concourse level 72*e* includes an upper concourse 78*e* with bridges 82*e* in a baseball configuration. The upper concourse 78*e* provides access to an upper seating deck 90 in the outer seating section band 42 through suitable vomitoria 80.

Vertical circulation is provided by stair/ramp towers 92*a* and stair/elevator towers 92*b* positioned at suitable locations around the perimeter of the stadium 2. In addition to the vertical circulation towers 92, additional vertical circulation means, such as stairs, ramps and elevators can be provided where appropriate in the stadium 2.

V. Support System 10

The support system 10 includes various other facilities associated with operating the stadium 2 and accommodating the spectators, staff and team personnel. Such facilities can include locker facilities 94, service facilities 96, concessions 98, pantries 102 and toilets 104. The support system 10 further includes appropriate mechanical and electrical systems located at 106 and other components appropriate to the stadium 2.

VI. Reconfiguration Procedure

The procedure for transforming the multi-purpose stadium 2 from a football configuration (FIGS. 1*a*, 2*a*, 3*a* and 9) to a baseball configuration (FIGS. 1*b*, 2*b*, 3*b* and 18) will be described. The baseball-to-football reconfiguration procedure is essentially the same in reverse.

Figure 9:
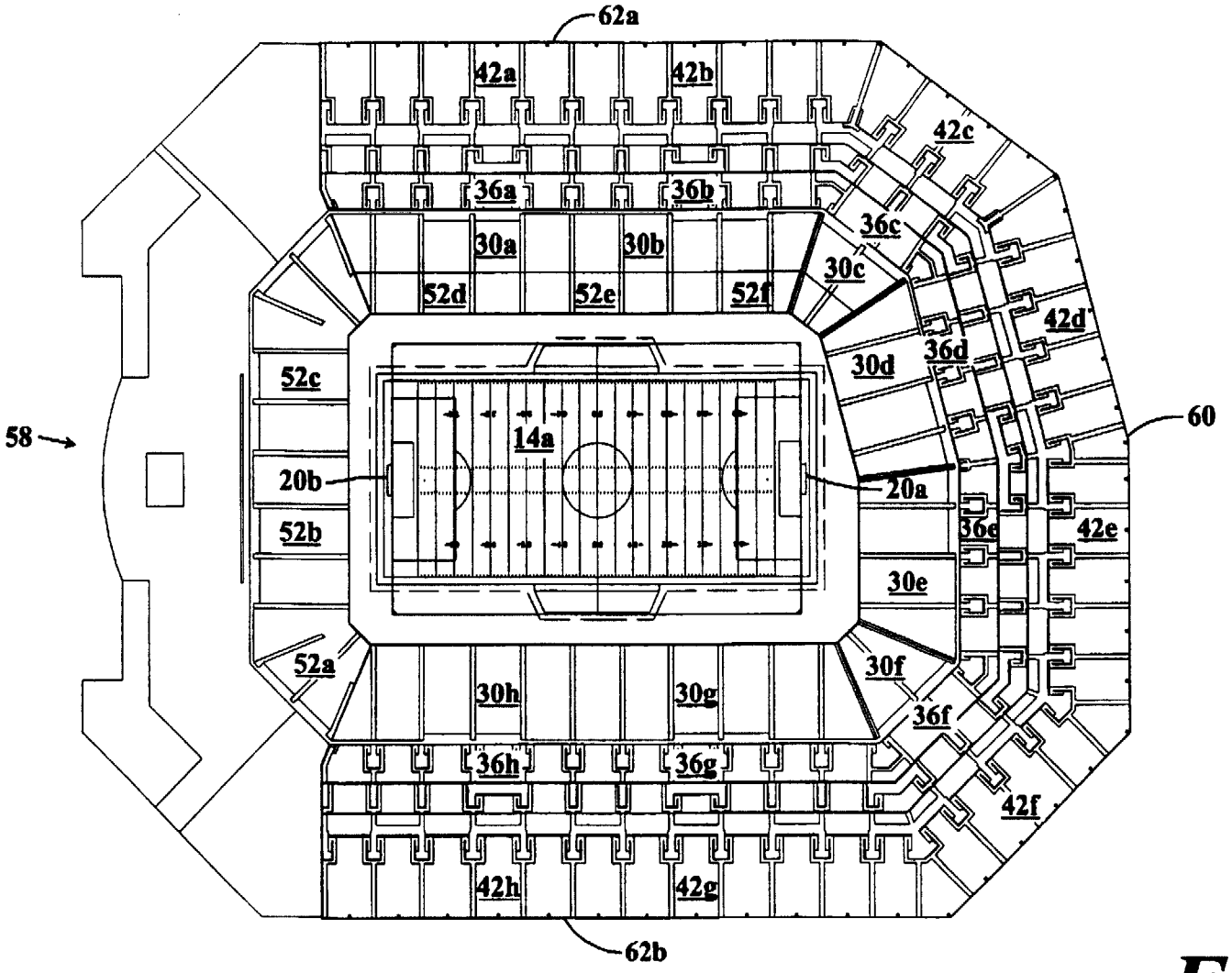
FIG. 9 is a plan view of the stadium in a football configuration.
Figure 10:
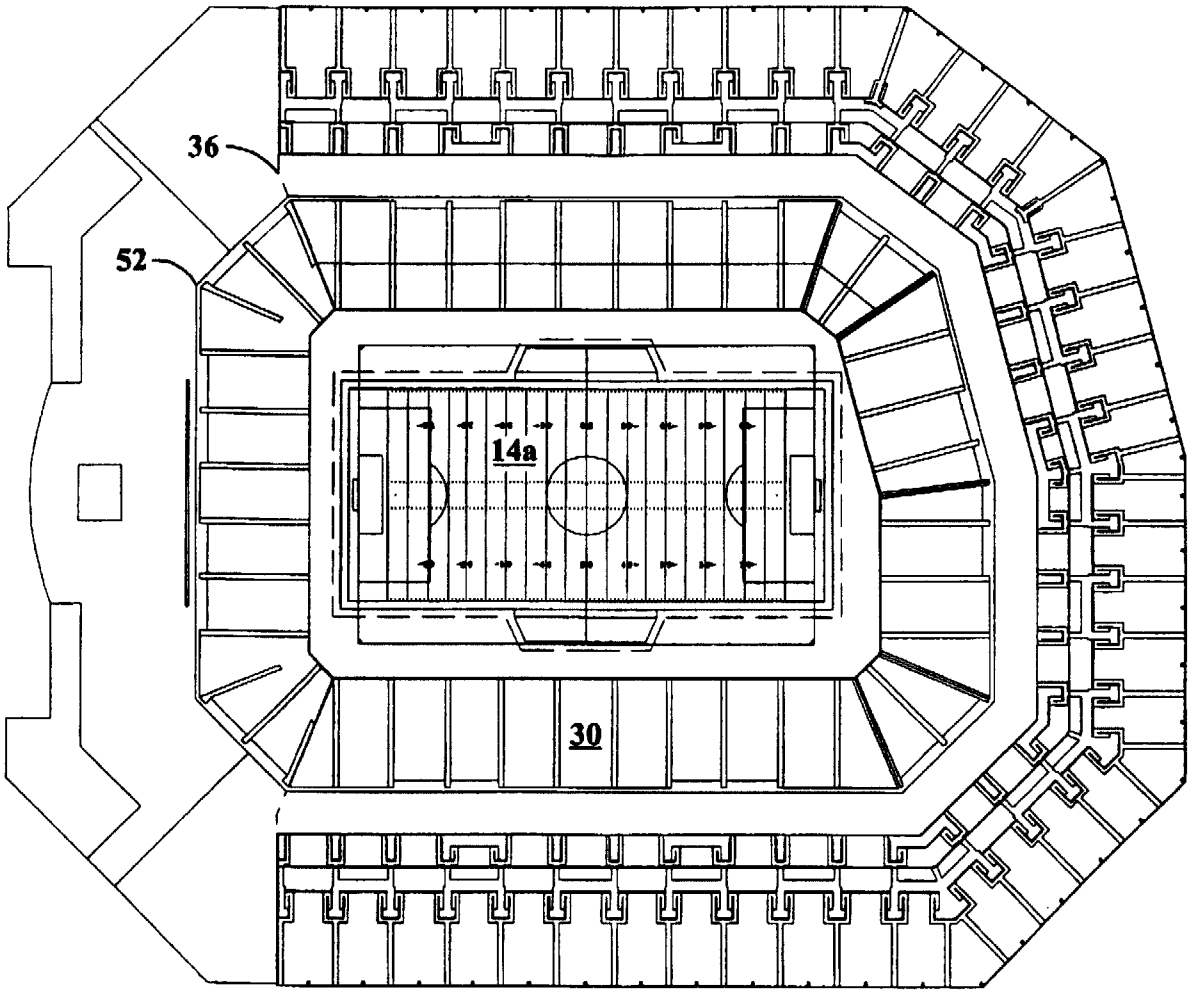
FIG. 10 is a plan view of the stadium showing the location of a vertically movable seating section band being lowered.
Figure 11:
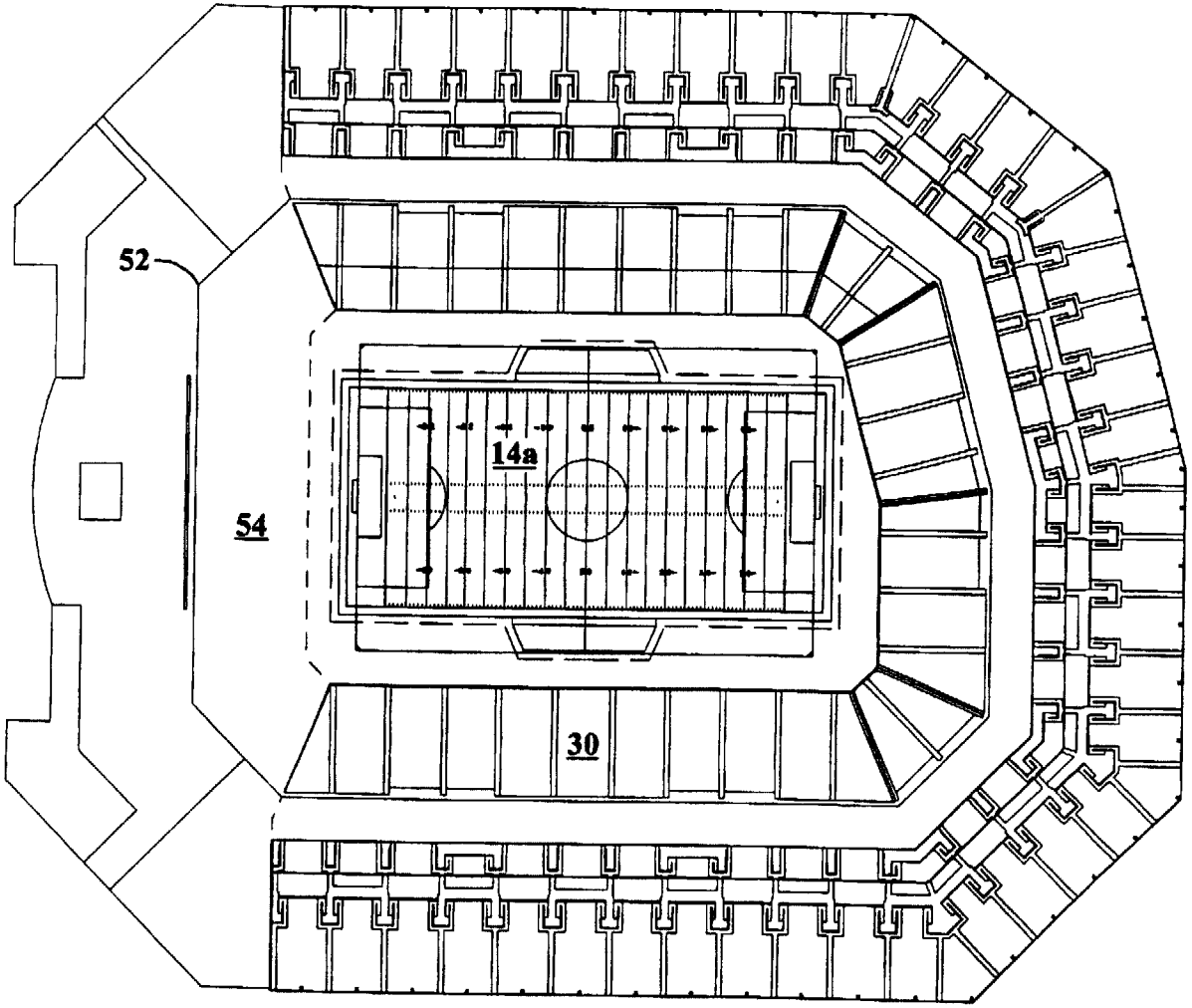
FIG. 11 is a plan view of the stadium showing the location of end zone removable band seating sections being removed or retracted.
Figure 12:
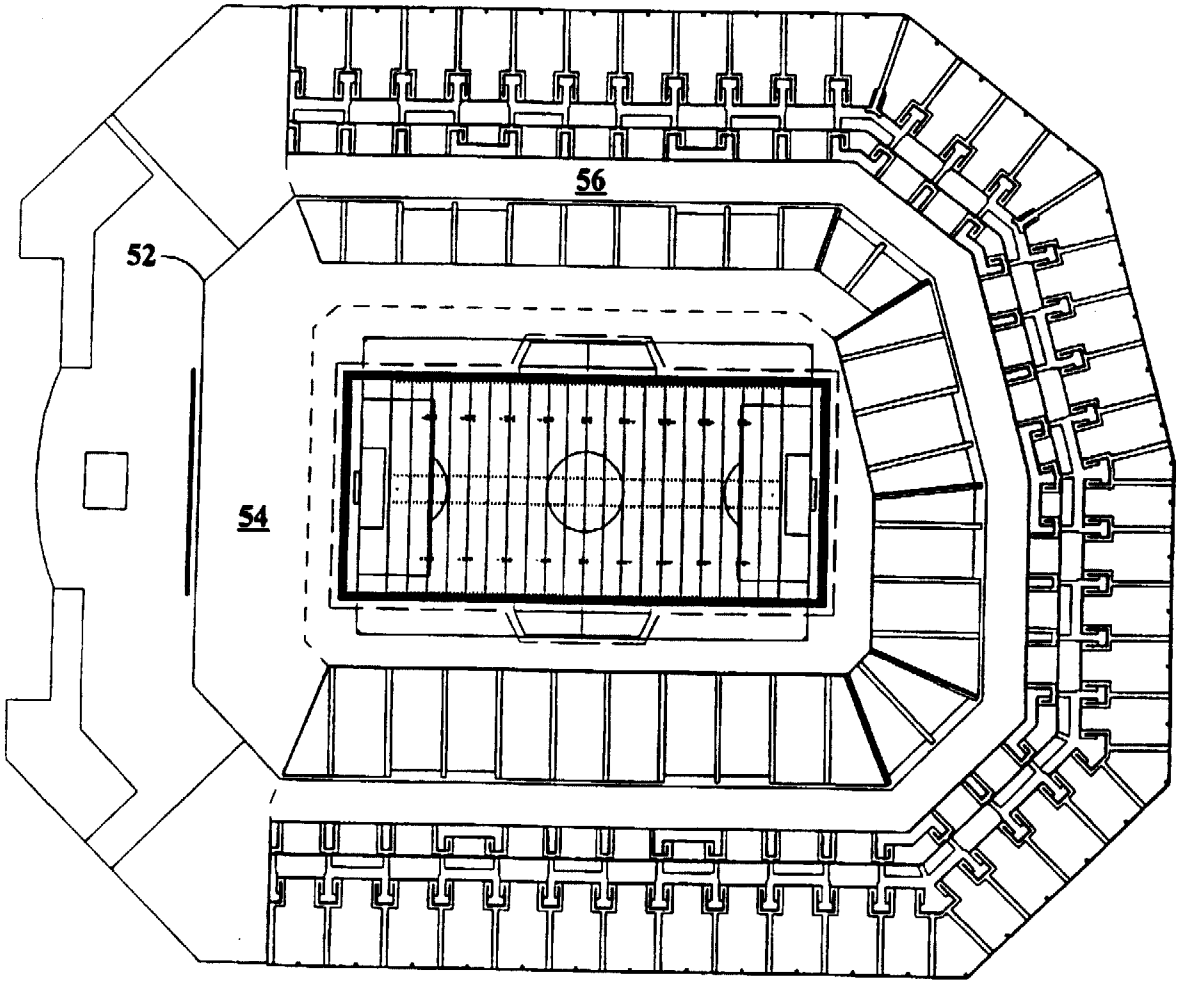
FIG. 12 is a plan view of the stadium showing the location of sideline removable band seating sections being removed or retracted.
Figure 13:
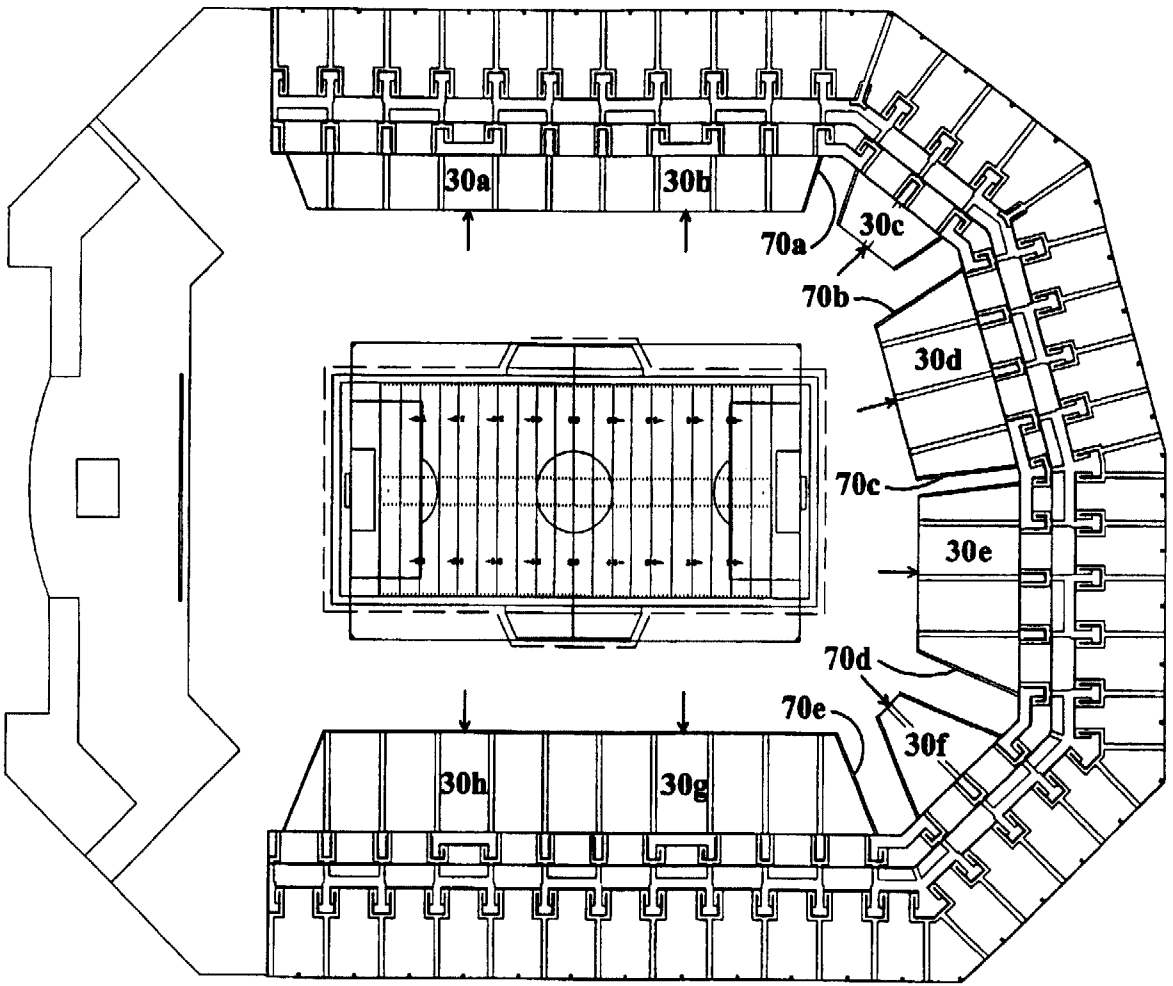
FIG. 13 is a plan view of the stadium showing a horizontally movable band of seating sections being slid or shifted radially outwardly.
Figure 14:
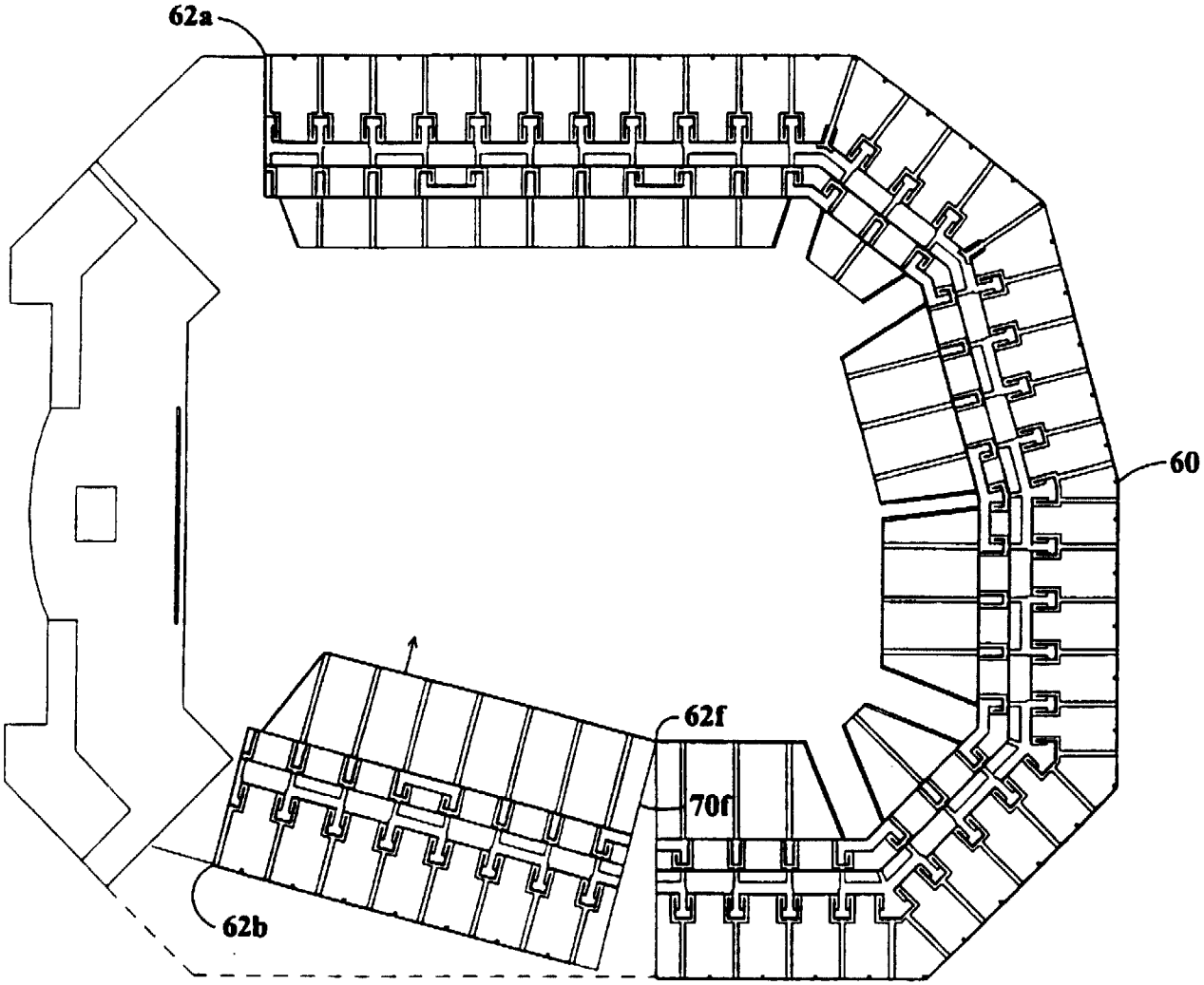
FIG. 14 is a plan view of the stadium showing a seating bowl second wing rotatable extension being rotated inwardly.
Figure 15:
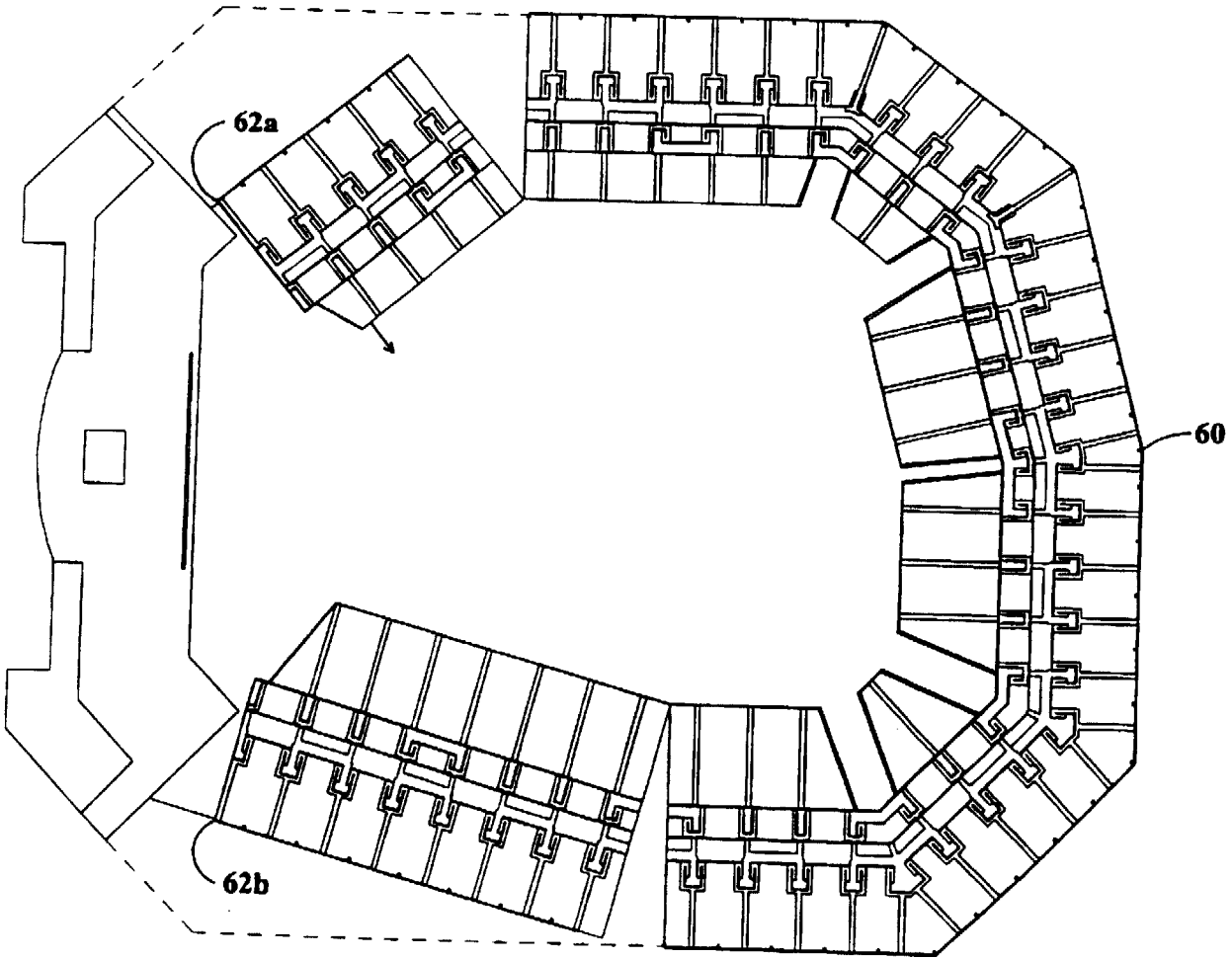
FIG. 15 is a plan view of the stadium showing a seating bowl first wing rotatable extension being rotated inwardly.
Figure 16:
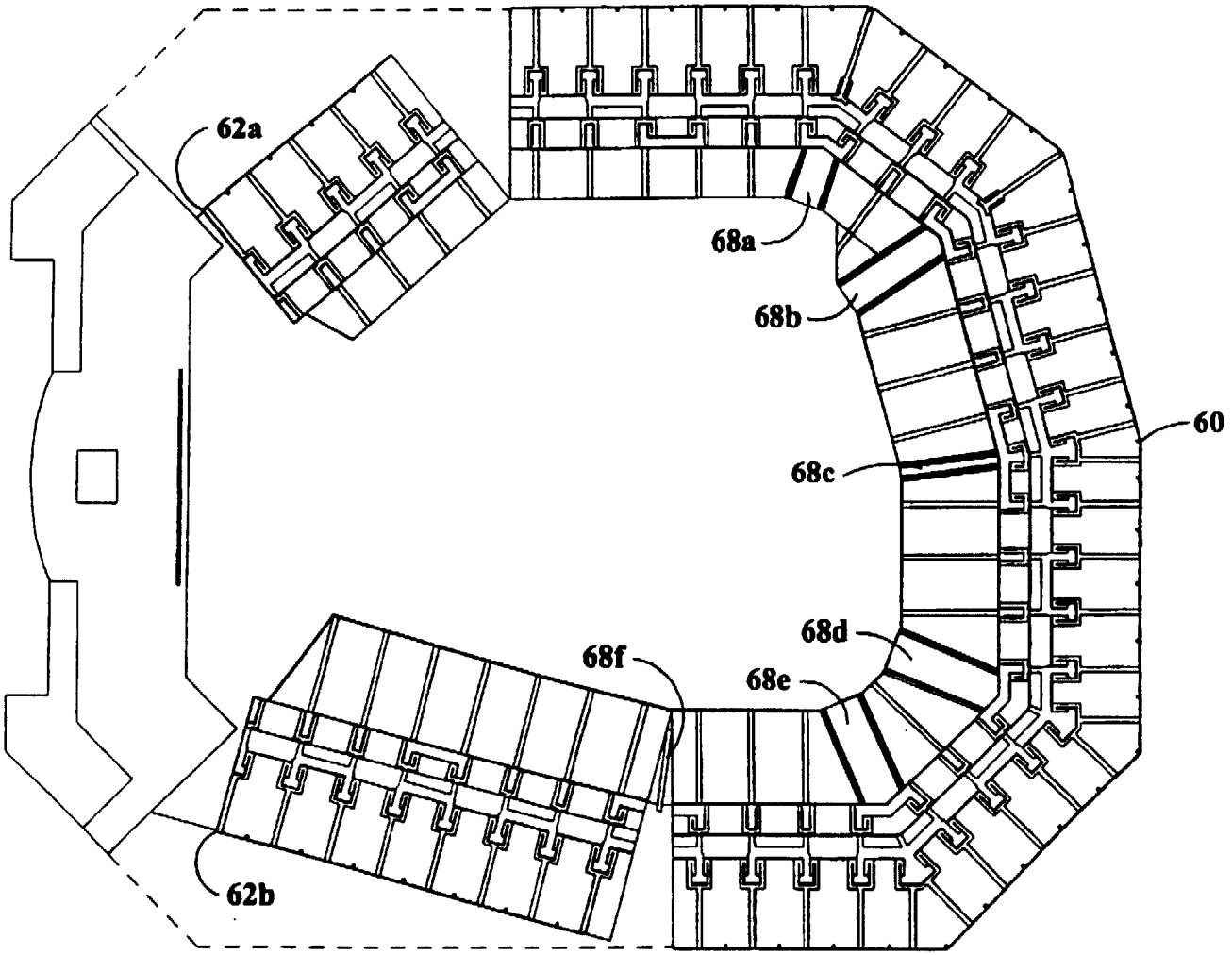
FIG. 16 is a plan view of the stadium showing the locations of infill seating sections being placed.
Figure 17:
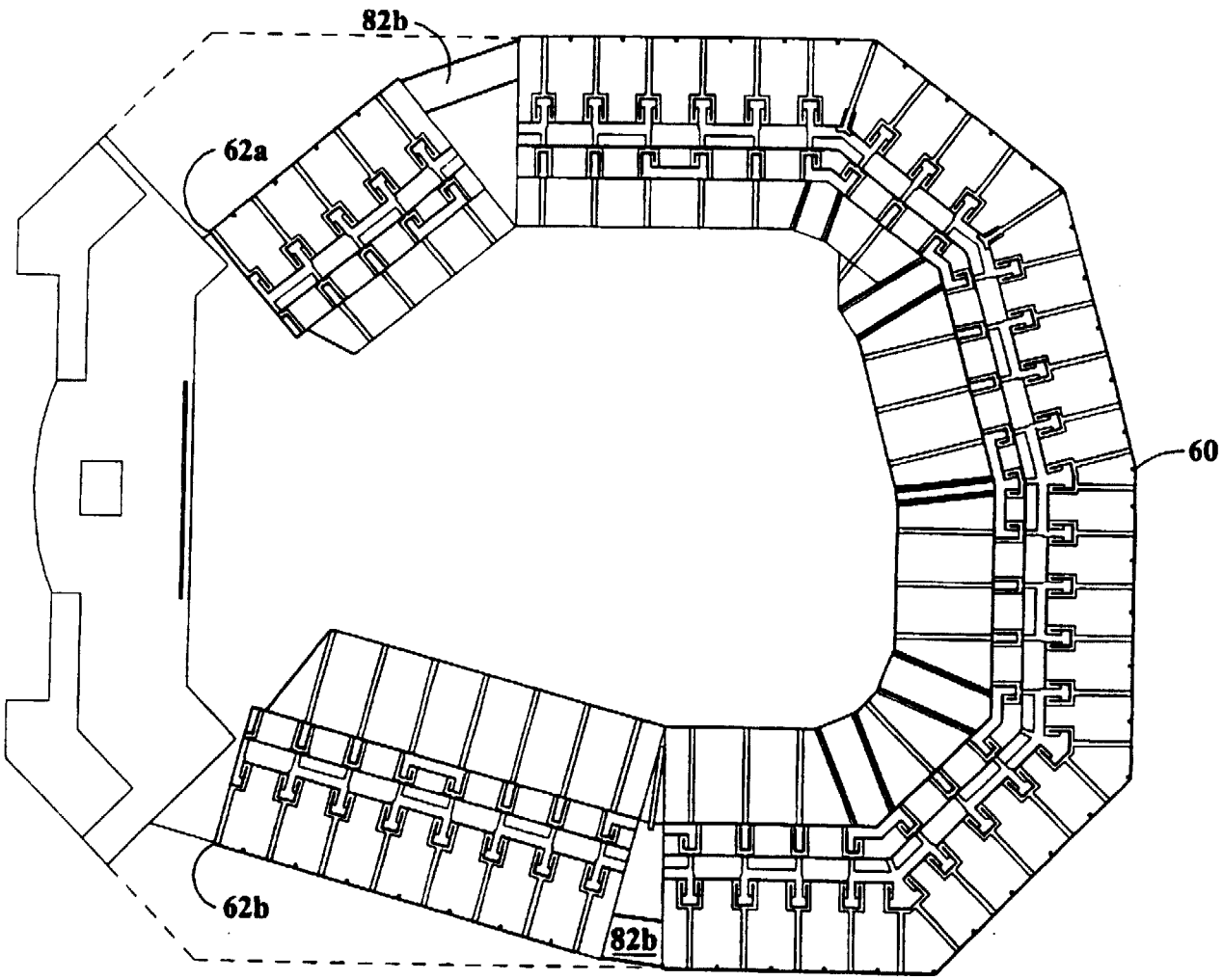
FIG. 17 is a plan view of the stadium showing the locations of concourse bridges being inserted in gaps formed by the rotated wing extensions.
Figure 18:
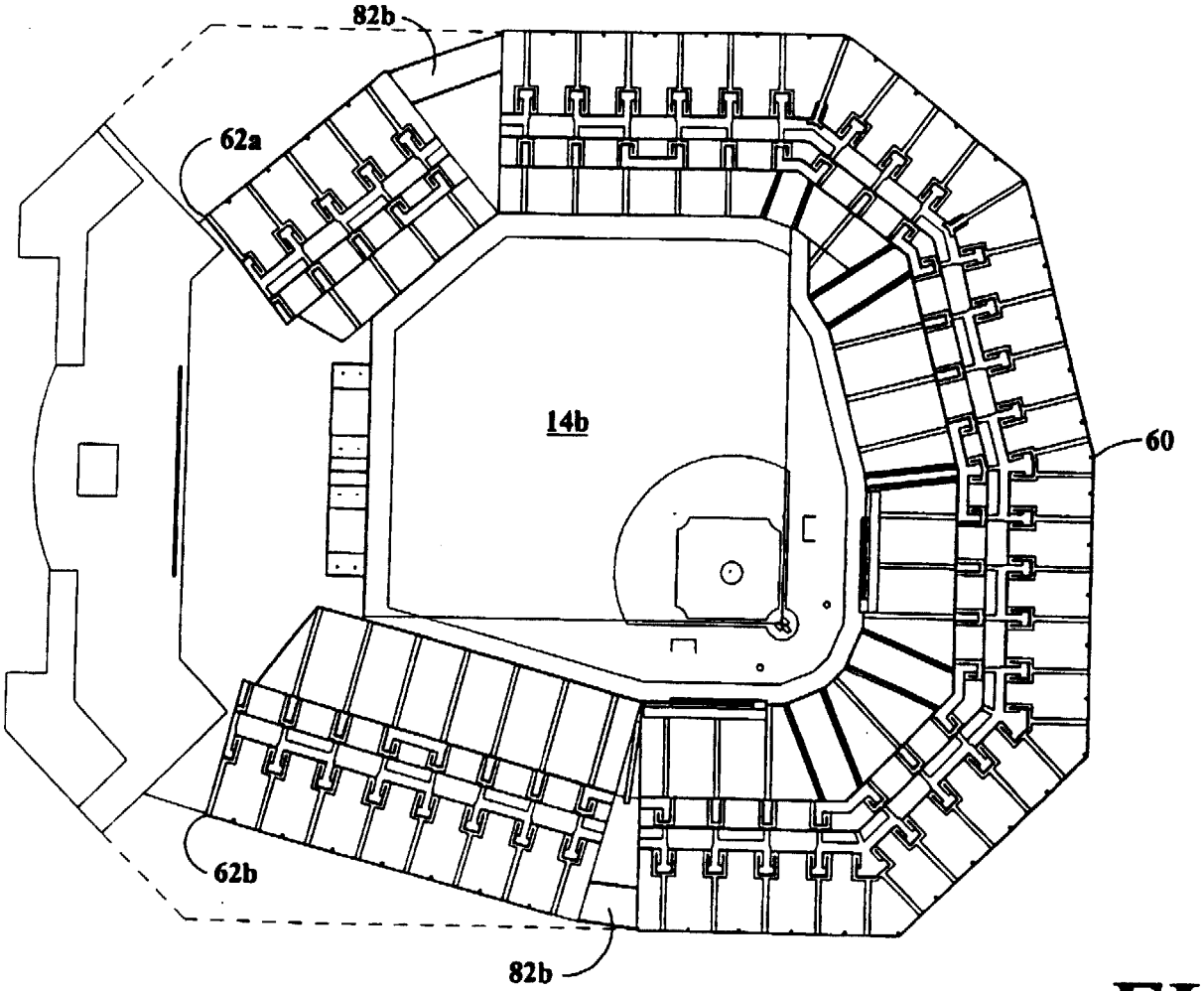
FIG. 18 is a plan view of the stadium in a baseball configuration.
Figure 19:
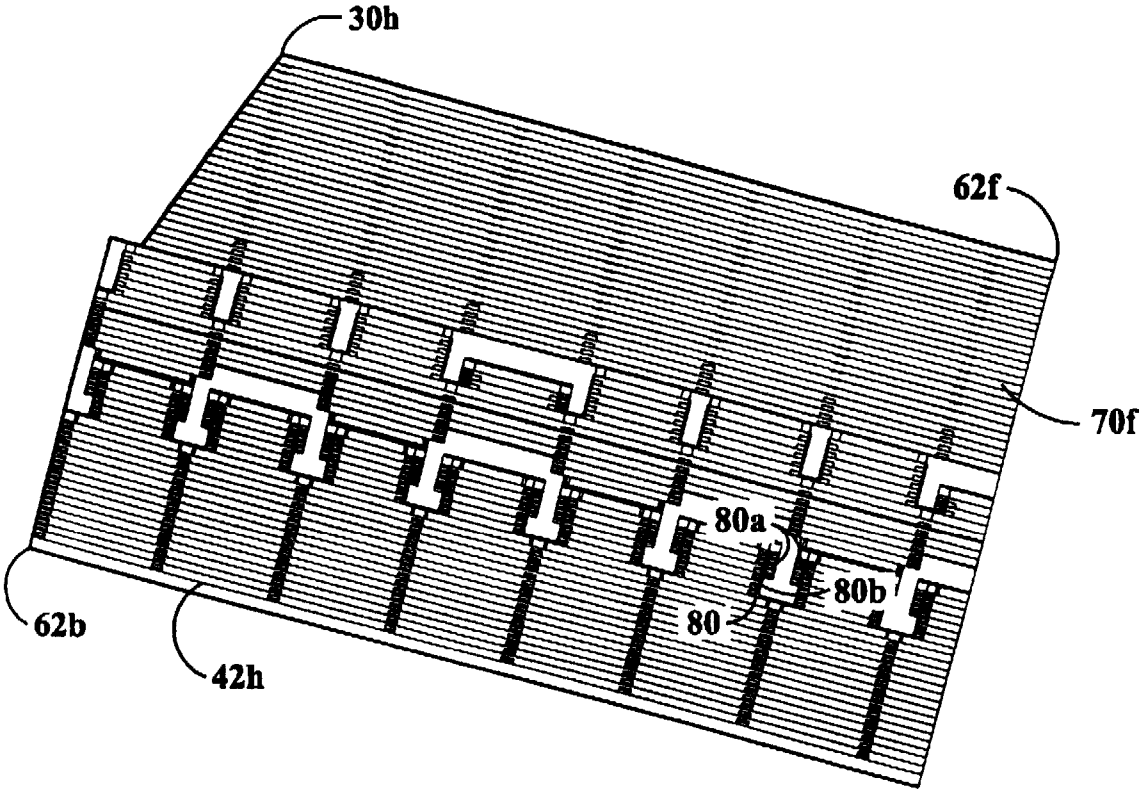
FIG. 19 is a plan view of the seating bowl second wing rotatable extension.
Figure 20A:
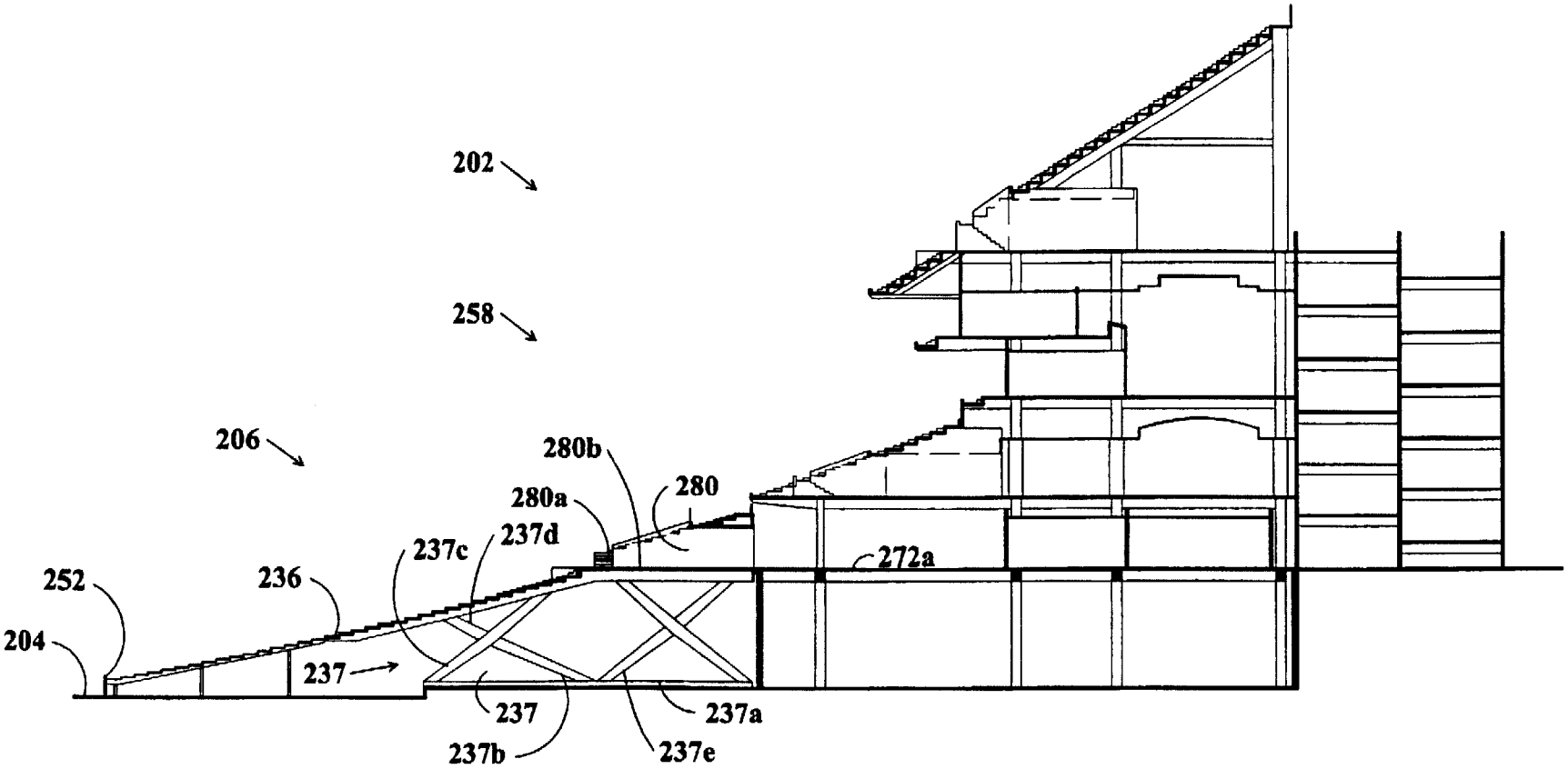
FIG. 20*a* is a vertical cross-section of a multi-purpose stadium with a reconfigurable seating system comprising a first modified embodiment of the present invention, shown in a football configuration.
Figure 20B:
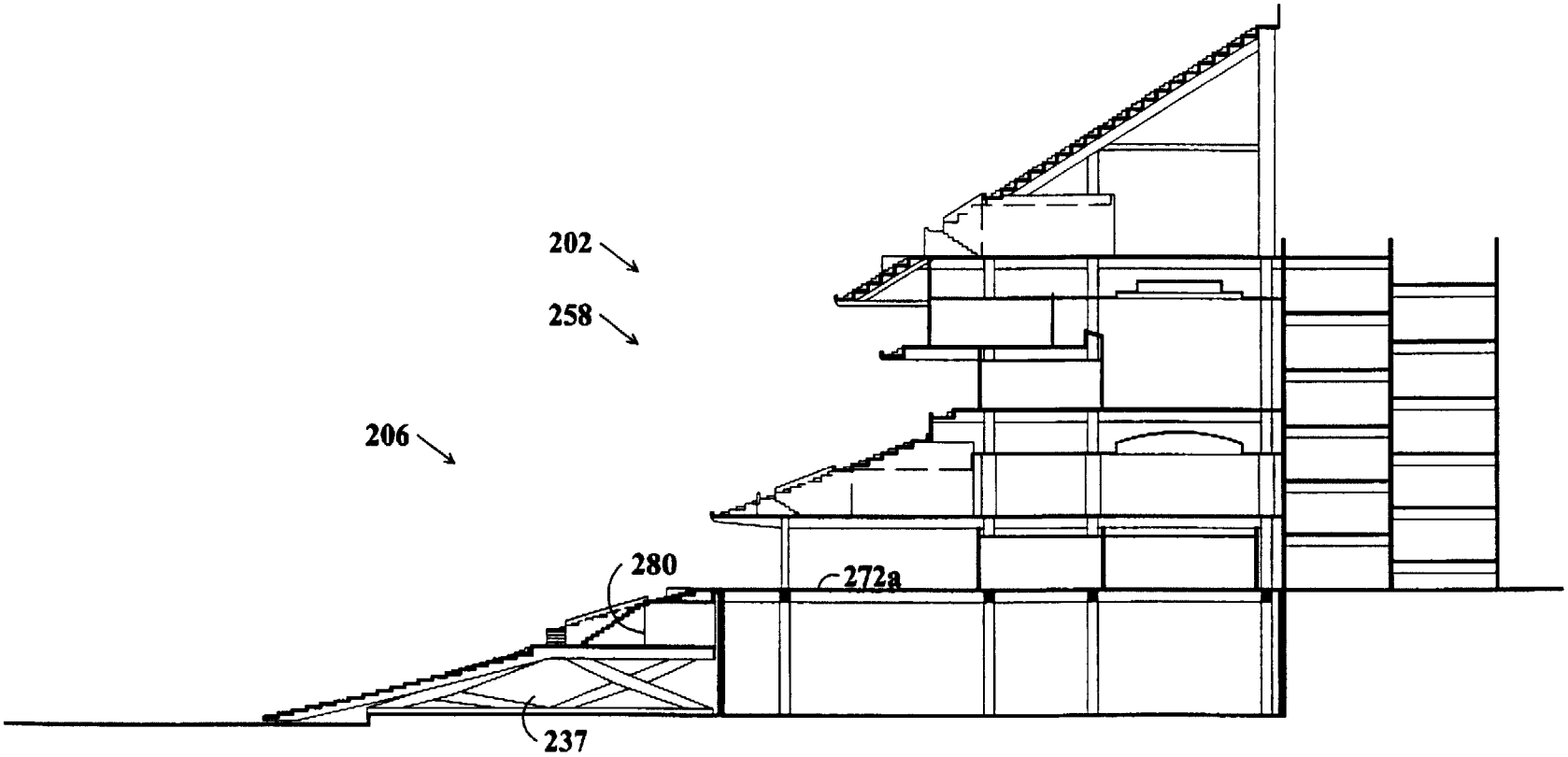
FIG. 20*b* is a vertical cross-section of the stadium, shown in a baseball configuration.
Figure 21A:
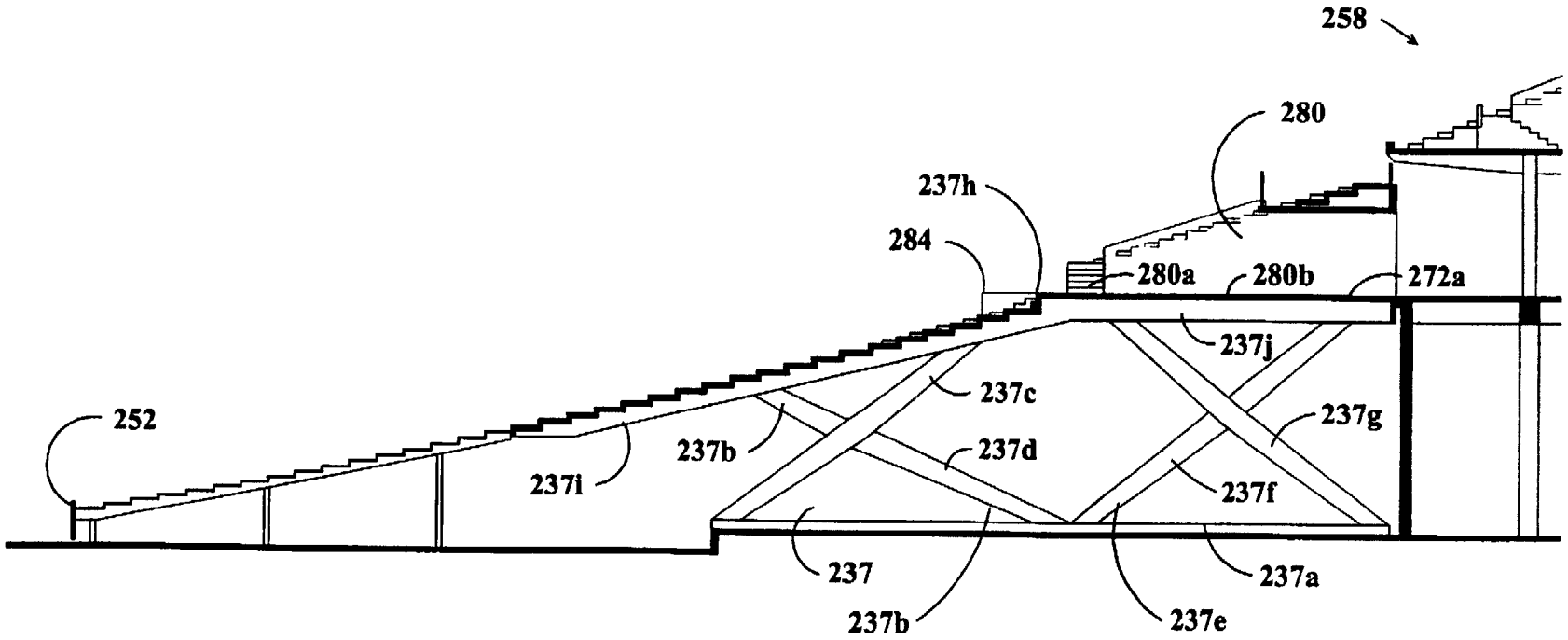
FIG. 21*a* is an enlarged, vertical cross-section of the stadium, shown in a football configuration.
Figure 21B:
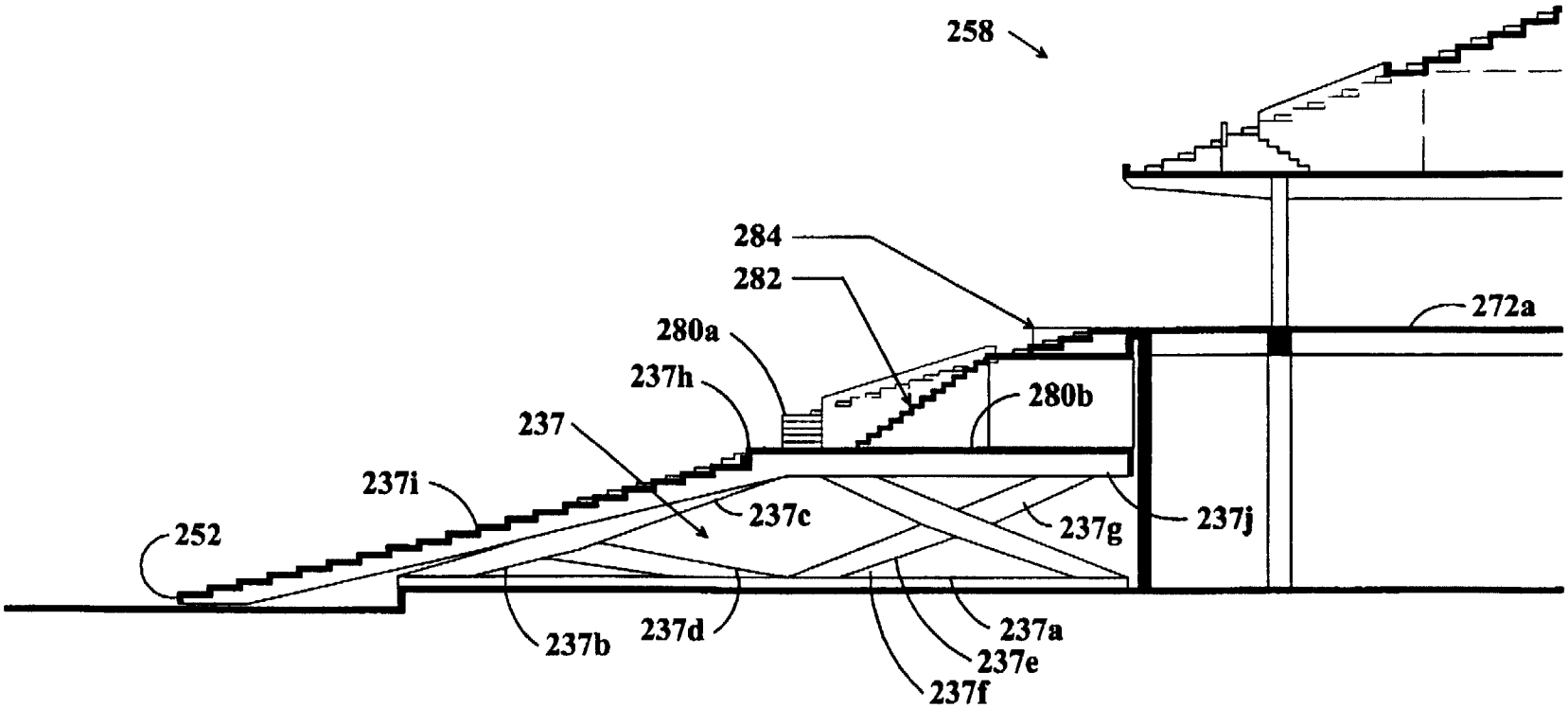
FIG. 21*b* is an enlarged, vertical cross-section of the stadium, shown in a baseball configuration.

FIG. 9 shows the stadium 2 in a football configuration. An exemplary procedure for conversion to a baseball configuration could include the following steps:

1. Lower vertically movable band of seating sections 36*a–h* (FIG. 10).
2. Remove or retract end zone seating comprising removable band seating sections 52*a–c* (FIG. 11).
3. Remove or retract removable band seating sections 52*d–f* along the football field first sideline 16*a* (FIG. 12).
4. The horizontally movable band seating sections 30*a–h* are slid or shifted radially outwardly (FIG. 13).
5. Rotate the second wing rotating extension 62*d* inwardly approximately 15° (FIG. 14).
6. Rotate the first wing rotating extension 62*c* inwardly approximately 40° (FIG. 15).
7. Place infill seating sections 68*a–f* in respective gaps or pockets 70*a–f* formed between the separated horizontally movable band sections 30*b–h* (FIG. 16).
8. Install bridges 82*b,c,e* to interconnect respective concourses 78*b,c,e* (FIG. 17).
9. Prepare baseball playing field 14*b* and baseball field wall 64*b* (FIG. 18).

VII. Operation

In operation, the multi-purpose stadium 2 provides nearly optimal configurations for both football and baseball sporting events, and could be adapted to accommodate additional playing field or stage configurations for other events. More particularly, the dynamic portions of the seating bowl 58, i.e., the horizontally movable band 30, the vertically movable band 36, the removable band 52, the wing rotatable extensions 62*c,d* and the infill seating sections 68 all cooperate to optimize the spectator seating conditions by providing desirable proximity to the playing field 14 while maintaining desired sightlines for game play action viewing throughout the respective seating bowls 58. The reconfiguration procedure, in addition to optimizing spectator proximity and views of the playing fields 14, automatically adjusts the stadium seating capacity to optimal levels for baseball and football. For example, seating capacities of 65,000 to 70,000 are generally desirable for football. Optimal seating capacities for baseball are generally about 40,000 to 50,000. The changes in seating capacity to achieve these optimal ranges are accomplished by lowering the vertically movable band 16, by retracting or removing the removable band 52 and by partly making up the seating capacity reduction with the addition of the infill seating 68.

Within the scope of the present invention, a wide variety of alternative configurations and seating capacities could be accommodated. In particular, the various seating sections could be adapted to different sizes and shapes as required for particular applications of the present invention. Additional, removable seating sections could be added to the seating bowl 58, for example, in the left field area in a baseball configuration. Moreover, other characteristics of the stadium 2 could be varied within the scope of the present invention. For example, an existing stadium could be retrofit with the reconfigurable seating system 6, and the stadium 2 could comprise a domed structure.

VIII. First Modified Embodiment Reconfigurable Seating System for Multi-Purpose Stadium A seating system 206 for a multi-purpose stadium 202 is shown in FIGS. 20*a*, 20*b*, 21*a* and 21*b*, and comprises a first modified or alternative embodiment of the present invention. The seating system 206 includes a vertically movable seating section band 236 and a removable seating section band 252.

The vertically movable seating section band 236 is vertically, movably supported by a lift subsystem 237 including a base frame 237*a* mounting an inner scissor jack subassembly 237*b* including pivotally interconnected, criss-crossed arms 237*c,d* and also mounts an outer scissor jack subassembly 237*e* including pivotally interconnected, criss-crossed arms 237*f,g*. A seating deck 237*h* of the vertically movable seating section band 236 includes an inner section 237*i* mounted on the inner scissor jack subassembly 237*b* and an outer section 237*j* mounted on the outer scissor jack subassembly 237*e*.

In a football configuration (FIGS. 20*a* and 21*a*) the vertically movable seating section band 236 is raised to its upper position as shown and extends both above and below a level of a main concourse 272*a*. A vomitoria 280 includes stairs 280*a* and a passage 280*b* and provides access from the main concourse 272*a* to the vertically movable seating section band 236 and vice-versa.

For reconfiguration to a baseball playing field configuration (FIGS. 20*a* and 21*a*), the removable seating section band 252 is removed and stored at a suitable location, i.e., elsewhere on the premises or off site. The vertically movable seating section band 236 is lowered by means of the lift subsystem 237. The uppermost rows of the vertically movable seating section band 236 are thus located at approximately the level of the main concourse 272*a* and the lowermost rows thereof are located adjacent a playing area 204. To provide more direct access from the main concourse 272*a* to the lower, inner seating deck section 237*i*, a removable accelerated stair 282 is installed in the vomitoria passage 280*b*.

A wheelchair platform 284 is removably mounted on the vertically movable seating section band 236 and in a football configuration is located adjacent the vomitoria passage 280*b*, i.e., partway into the vertically movable seating section band 236. For a baseball configuration the wheelchair platform 284 is relocated to an area adjacent the uppermost rows of the vertically movable seating section band 236. The wheelchair platform 284 is thus positioned on a level with the main concourse 272*a* in both configurations, and is positioned to provide wheelchair occupants located on the wheelchair platform 284 with sightlines which permit viewing the playing area 204 under various conditions. The wheelchair platform 284 is preferably located at a sufficient height to maintain sightlines and playing field visibility for wheelchair-bound spectators, even if spectators in front of them are standing. Moreover, the wheelchair platforms 84 are sized sufficiently to provide appropriate wheelchair turning radii, ingress and egress.

Operation of the reconfigurable seating system 206 in the stadium 202 is similar to operation of the reconfigurable seating system 206 described above, with suitable modifications to the reconfiguration steps to accommodate repositioning and reconfiguring the vertically movable seating section band 236 and the removable seating section band 252. Other components of a seating bowl 258 can be suitably modified to employ the modified embodiment seating system 206 or other reconfigurable seating systems which embody the present invention.

It is to be understood that while certain forms of the present invention have been illustrated and described herein, it is not to be limited to the specific forms or arrangement of parts described and shown. For example, the stadium configurations disclosed herein could be reversed or otherwise reconfigured within the scope of the present invention.

What is claimed and desired to be secured by Letters Patent is as follows:

1. In combination with a multi-purpose stadium having a playing field reconfigurable between first and second playing field configurations, each said playing field configuration having a respective playing field side, the improvement of a reconfigurable seating system, which comprises:

(a) a horizontally-movable band of seating sections having a first position extending along the first playing field configuration side and a second position extending along the second playing field configuration side;

(b) a vertically-movable band of seating sections having a first, raised, use position associated with said first playing field configuration and a second, lowered, storage position associated with said second playing field configuration;

(c) said horizontally-movable band in its second position at least partly overlying said vertically-movable band in its lowered position;

(d) translation means for horizontally moving said horizontally-movable band between its first and second positions; and (e) lift means for raising and lowering said vertically-movable band.

2. The combination according to claim 1, which includes:

(a) a seating bowl including said seating section bands and having a wing with a rotatable extension rotatable between a first, aligned position generally aligned with said wing and associated with said first playing field configuration and a second, rotated position rotated inwardly with respect to said wing and associated with said second playing field configuration;

(b) said horizontally-movable band seating sections being adjoined with said seating system in its first configuration; and (c) rotating means for rotating said wing extension.

3. The combination according to claim 2, which includes:

(a) a plurality of gaps formed in said horizontally-movable seating section band between respective horizontally-movable seating sections with said seating system in its second configuration.

4. The combination according to claim 3, which includes:

(a) a plurality of infill seating sections selectively positioned within respective horizontally-movable seating section band gaps with said seating system in its second configuration.

5. The combination according to claim 2, which includes:

(a) said vertically-movable band comprising a plurality of seating sections corresponding to said horizontally-movable band seating sections and located radially outwardly therefrom.

6. The combination according to claim 1, which includes:

(a) a removable seating section band comprising a plurality of removable band seating sections and located along the first playing field side between the playing field and the horizontally-movable band.

7. The combination according to claim 1, which includes:

(a) a seating bowl formed by said seating section bands and including a base, a first wing and a second wing; and (b) each said seating bowl band having a respective rotatable extension rotatable between a first position aligned with a respective wing and associated with said first playing field configuration and a second position rotated inwardly and associated with said second playing field configuration.

8. The combination according to claim 7, which includes:

(a) said seating bowl including an outer seating band comprising a plurality of seating sections located radially outwardly from said vertically-movable band.

9. The combination according to claim 7 wherein each said seating bowl wing extension includes respective seating sections of said horizontally-movable, vertically-movable and outer seating section bands.

10. The combination according to claim 7 wherein said seating bowl includes:

(a) a removable seating section band comprising a plurality of removable seating sections, including a base extending along an end of said first playing field and a wing extending along a side of said first playing field, said removable seating section band being associated with said first playing field configuration.

11. A multi-purpose stadium, which includes:

(a) a first playing field having a generally rectangular configuration with first and second sides and first and second ends;

(b) a second playing field having a generally five-sided configuration with first, second, third, fourth and fifth sides, an intersection of said first and fifth sides, and an axis extending from said intersection to said third side; and c) a seating system including:

(1) a first configuration corresponding to said first playing field;

(2) a second configuration corresponding to said second playing field;

(3) a horizontally-movable band comprising a plurality of seating sections each having multiple seating rows, said horizontally-movable band having a first position corresponding to said first playing field and a second position corresponding to said second playing field;

(4) a vertically-movable band comprising a plurality of seating sections each having multiple seating rows, said vertically-movable band having a first, raised use position corresponding to said first playing field outside of and in proximity to said horizontally-movable band and a second, lowered storage position corresponding to said second playing field at least partly under said horizontally-movable section;

(5) means for moving said horizontally-movable seating band between its first and second positions; and (6) lift means for raising and lowering said vertically-movable seating section band between its raised and lowered positions.

12. The stadium according to claim 11 includes:

(a) said seating system forming a seating bowl with a base, a first wing and a second wing;

(b) each said seating bowl wing having a rotatable extension rotatable between first and second positions corresponding to said first and second playing fields respectively; and (c) rotating means for rotating said wing extensions between said first and second positions.

13. The stadium according to claim 11, which includes:

(a) a removable band of seating sections associated with said first playing field and having a base located adjacent one of said first playing field ends and a wing located adjacent one of said first playing field sides, said removable band base extending generally between said seating bowl wings and said removable band wing being positioned inside a portion of said horizontally-movable band.

14. The stadium according to claim 11, which includes:

(a) said seating sections of said horizontally-movable band adjoining each other with said horizontally-movable band in its first position;

(b) a plurality of said horizontally-movable band seating sections being spaced apart and forming gaps therebetween with said horizontally-movable band in its second position; and (c) a plurality of infill seating sections located in said horizontally-movable band gaps.

15. The stadium according to claim 11, which includes:

(a) said seating system having an outer seating section band comprising a plurality of seating sections and located radially outwardly from said vertically-movable seating section band.

16. The stadium according to claim 15, which includes a circulation system having:

(a) a main concourse level with a main concourse providing access to said horizontally and vertically movable seating section bands and including ingress and egress means to said stadium;

(b) a club level including a club level concourse providing access to a portion of said outer seating band;

(c) a lower suite level including a lower suite level concourse providing access to a portion of said outer seating band;

(d) an upper suite level including an upper suite level concourse providing access to a portion of said outer seating band; and (e) an upper concourse level including an upper concourse providing access to a portion of said outer seating section band.

17. The stadium according to claim 16, which includes said circulation system having a plurality of vertical circulation towers, at least one of which includes ramps and stairs and at least another one of which includes stairs and an elevator.

18. The stadium according to claim 12 wherein:

(a) said horizontally-movable band forms a field wall; and (b) said horizontally-movable band at said first seating bowl wing extension forms a center field wall associated with said second playing field third side.

19. The stadium according to claim 11 wherein said lift means includes:

(a) a base;

(b) vertically extensible scissor jack means including a pair of pivotally interconnected arm means connected to said base and extending upwardly therefrom in a raised position; and (c) a seating deck mounted on said vertically extensible scissor jack means.

20. A multi-purpose stadium, which comprises:

(a) a first, football playing field having first and second sidelines and first and second end zones;

(b) a second, baseball playing field having:

(1) a generally 5-sided configuration with first, second, third, fourth and fifth sides; an intersection of said first and fifth sides; a home plate in proximity to said intersection; and an axis extending from said intersection to said third, center field side;

(c) a seating system including:

(1) a first, football configuration corresponding to said football playing field;

(2) a second, baseball configuration corresponding to said baseball playing field;

(3) a horizontally-movable band comprising a plurality of seating sections each having multiple seating rows, said horizontally-movable band having a first position corresponding to said football playing field and a second position corresponding to said baseball playing field; said sections being adjoined in said first position and positioned in spaced relation with gaps formed therebetween in said second position;

(4) translation means for horizontally moving said horizontally-movable band between its first and second positions, said translation means expanding said horizontally-movable band radially outwardly from its first position to its second position and contracting said horizontally-movable band radially inwardly from its second position to it first position;

(5) a vertically-movable band of seating sections each having multiple seating rows, said vertically-movable band having a first raised, use position corresponding to said football configuration and a second, lowered, storage position corresponding to said baseball configuration; said vertically-movable band being located at least partly under said horizontally-movable band in said baseball configuration;

(6) lift means for raising and lowering said vertically-movable band between its raised and lowered positions and including a base located generally at a level of said playing fields, vertically extensible means connected to said base and a seating deck mounted on said vertically extensible means;

(7) a removable/relocatable band comprising a plurality of seating sections having multiple seating rows and having a base located adjacent one of said end zones and a wing located adjacent one of said sidelines of said football playing field and being removed for a baseball configuration;

(8) a plurality of infill seating sections each having multiple seating rows and being located in a respective horizontally-movable seating section gap in said baseball configuration, said infill seating section being removable from said seating system for said football configuration;

(9) an outer seating section band comprising a plurality of seating sections each having multiple seating rows, said outer seating section band being located generally radially outwardly from said vertically-movable seating section band;

(10) a seating bowl formed by said seating section bands and having a base located adjacent a respective football field end zone and along one of said baseball field first and fifth sides, a pair of seating bowl wings each located adjacent a respective football field side line and adjacent a respective baseball field side, one of said seating bowl wings having a rotatable extension generally aligned with said wing in a football configuration and rotated inwardly in a range of about thirty degrees to fifty degrees in a baseball configuration for location adjacent said baseball field third side, said other seating section wing having a rotatable extension generally aligned with said wing in said football configuration and rotated inwardly in the range of about ten degrees to twenty degrees in said baseball configuration; and (d) a circulation system including:

(1) a main concourse level with a main concourse providing access to said horizontally and vertically movable seating section bands and including ingress and egress means to said stadium;

(2) a club level including a club level concourse providing access to a portion of said outer seating band;

(3) a lower suite level including a lower suite concourse providing access to a portion of said outer seating band;

(4) an upper suite level including an upper suite concourse providing access to a portion of said outer seating band;

(5) an upper concourse level including an upper concourse providing access to a portion of said outer seating section band;

(6) a plurality of ramp/stair towers each including stairs and a ramp;

(7) a plurality of elevator means located on said stadium perimeter; and (8) a support system including a plurality of concessions, locker facilities, rest room facilities, mechanical support and electrical support means.

21. In combination with a multi-purpose stadium having a playing field reconfigurable between first and second playing field configurations, each said playing field configuration having a respective playing field side, the improvement of a seating system, which comprises:

(a) means for modifying the stadium seating capacity and the spectator sightlines including a repositionable seating section repositionable between a first position associated with said first playing field configuration and a second position associated with said second playing field configuration; and (b) said repositionable seating section including a wing having a horizontally moveable seating band adapted to change the depth of said wing from first and second depths associated with said first and second positions respectively.

22. The combination according to claim 21, which includes:

(a) said seating system having a seating band extending generally parallel to a respective playing field side in each said playing field configuration.

23. The combination according to claim 21, which includes:

(a) a removable seating section positioned adjacent the playing field in its first configuration; and (b) a vertically movable seating section positioned adjacent the playing field in its second configuration.

24. The combination according to claim 23, which includes:

(a) said vertically movable seating section having a raised position associated with said first playing field configuration and a lowered position associated with said second playing field configuration; and (b) a lift subsystem including means for raising and lowering said vertically movable seating section between its raised and lowered positions.

25. The combination according to claim 24 wherein said lift subsystem includes:

(a) a base;

(b) inner and outer scissor jack subassemblies mounted on said base; and (c) each said scissor jack subassembly including first and second pivotally, interconnected arms each connected to said base and to said vertically movable seating section.

26. The combination according to claim 25, which includes:

(a) said vertically movable seating section including inner and outer seating deck sections connected to said inner and outer scissor jack subassemblies respectively.

27. The combination according to claim 23, which includes:

(a) said stadium having a main concourse;

(b) said vertically movable seating section having a vomitoria with a passage to said main concourse and stairs to seating rows;

(c) said vomitoria passage being generally level with said main concourse with said vertically movable seating section in its raised position and positioned in spaced relation below said main concourse with said vertically movable seating section in its lowered position; and (d) an accelerated stair run positioned in said vomitoria with said vertically movable seating section in its lowered position, said accelerated stair run extending from said main concourse to said vomitoria passage.

28. The combination according to claim 27, which includes:

(a) a wheelchair platform movable between a first position associated with said first playing field configuration with said vertically movable seating section in its raised position and located adjacent said vomitoria passage generally level with said main concourse and a second position associated with said second playing field configuration with said vertically movable seating section in its raised position and located at an upper, inner end of said vertically movable seating section band adjacent said main concourse and generally on a level therewith.

* * * * *